US010117804B2

(12) United States Patent
Nilsson et al.

(10) Patent No.: US 10,117,804 B2
(45) Date of Patent: Nov. 6, 2018

(54) CPR CHEST COMPRESSION MACHINE WITH CAMERA

(71) Applicant: Physio-Control, Inc., Redmond, WA (US)

(72) Inventors: Anders Nilsson, Akarp (SE); Jonas Lagerstrom, Fagersanna (SE); Bo Mellberg, Lund (SE); Anders Jeppsson, Lund (SE); Marcus Ehrstedt, Lund (SE); Bjarne Madsen Hardig, Lund (SE); Fredrik Arnwald, Lomma (SE); Erik von Schenck, Lomma (SE); Paul Rasmusson, Furulund (SE); Sara Lindroth, Lund (SE); Gregory T. Kavounas, Bellevue, WA (US)

( * ) Notice: Subject to any disclaimer, the term of this patent is extended or adjusted under 35 U.S.C. 154(b) by 565 days.

(21) Appl. No.: 14/642,027

(22) Filed: Mar. 9, 2015

(65) Prior Publication Data

US 2016/0143804 A1 May 26, 2016

Related U.S. Application Data

(60) Provisional application No. 62/082,928, filed on Nov. 21, 2014.

(51) Int. Cl.
*A61H 31/00* (2006.01)

(52) U.S. Cl.
CPC ..... *A61H 31/005* (2013.01); *A61H 31/006* (2013.01); *A61H 2201/0103* (2013.01);
(Continued)

(58) Field of Classification Search
CPC .... A61H 31/00; A61H 31/004; A61H 31/005; A61H 2201/5092
(Continued)

(56) References Cited

U.S. PATENT DOCUMENTS 4,095,590 A * 6/1978 Harrigan ..... A61H 31/005 434/265
6,161,033 A * 12/2000 Kuhn ..... A61B 90/36 600/407
(Continued)

FOREIGN PATENT DOCUMENTS

WO WO2014182982 11/2014

OTHER PUBLICATIONS

PCT Application No. PCT/US15/61232; International Search Report and Written Opinion of the ISA, dated Mar. 29, 2016.
(Continued)

*Primary Examiner* — Michael Tsai
*Assistant Examiner* — Christopher Miller
(74) *Attorney, Agent, or Firm* — Miller Nash Graham & Dunn LLP

(57) ABSTRACT

A CPR chest compression machine includes a retention structure configured to retain a patient's body, and a compression mechanism configured to perform automatically CPR compressions to the patient's chest. The CPR machine also includes a camera coupled to the retention structure or to the compression mechanism. The camera has a field of view that spans at least a certain portion of the patient's body, and is configured to acquire an image of what is spanned by its field of view. The image may be stored in a memory, displayed, transmitted, analyzed to diagnose the patient, detect shifting of the patient within the CPR machine, etc.

29 Claims, 21 Drawing Sheets

*COMPONENTS OF CPR MACHINE & ASSOCIATED SIGHT TARGET*

(52) U.S. Cl.
CPC ..... *A61H 2201/0176* (2013.01); *A61H 2201/0184* (2013.01); *A61H 2201/5035* (2013.01); *A61H 2201/5043* (2013.01); *A61H 2201/5046* (2013.01); *A61H 2201/5048* (2013.01); *A61H 2201/5058* (2013.01); *A61H 2201/5069* (2013.01); *A61H 2201/5084* (2013.01); *A61H 2201/5092* (2013.01); *A61H 2201/5094* (2013.01); *A61H 2201/5097* (2013.01); *A61H 2230/25* (2013.01)

(58) Field of Classification Search
USPC ..... 382/254–255, 260–279, 295–300, 103, 382/107, 128
See application file for complete search history.

(56) References Cited

U.S. PATENT DOCUMENTS 6,201,992 B1* 3/2001 Freeman ..... A61N 1/39 607/5
6,427,685 B1* 8/2002 Ray, II ..... G09B 23/288 128/200.24
6,459,933 B1* 10/2002 Lurie ..... A61N 1/3925 128/203.14
2001/0014781 A1* 8/2001 Nissim ..... A61H 7/001 601/133
2001/0016696 A1* 8/2001 Bystrom ..... A61H 31/005 601/41
2001/0047140 A1* 11/2001 Freeman ..... A61H 31/005 601/41
2003/0233129 A1* 12/2003 Matos ..... A61B 5/0006 607/5
2004/0015191 A1* 1/2004 Otman ..... A61N 1/37282 607/5
2004/0162510 A1* 8/2004 Jayne ..... A61H 31/005 601/41
2004/0162587 A1* 8/2004 Hampton ..... A61H 31/005 607/5
2005/0010274 A1* 1/2005 Dupelle ..... A61N 1/046 607/142
2006/0056655 A1* 3/2006 Wen ..... G06F 19/3418 382/103
2007/0060799 A1* 3/2007 Lyon ..... A61B 34/20 600/300
2008/0071162 A1* 3/2008 Jaeb ..... A61B 5/0059 600/407
2009/0149901 A1 6/2009 Jayne et al.
2010/0022904 A1 1/2010 Centen
2011/0201979 A1* 8/2011 Voss ..... A61H 31/004 601/41
2012/0016279 A1 1/2012 Banville et al.
2012/0116272 A1 5/2012 Hampton et al.
2012/0330200 A1* 12/2012 Voss ..... A61H 31/004 601/41
2013/0018288 A1* 1/2013 Jaffe ..... A61B 5/082 601/41
2013/0184618 A1 7/2013 Woerlee et al.
2014/0046228 A1 2/2014 Walker
2014/0066822 A1* 3/2014 Freeman ..... A61H 31/00 601/41
2014/0171840 A1* 6/2014 Aelen ..... A61H 31/00 601/41
2014/0342330 A1 11/2014 Freeman et al.
2014/0342331 A1* 11/2014 Freeman ..... G09B 23/288 434/265
2014/0343466 A1 11/2014 Herken et al.
2015/0045697 A1* 2/2015 Richard ..... A61H 31/005 600/587
2015/0045704 A1* 2/2015 Lurie ..... A61H 31/007 601/41
2015/0051492 A9 2/2015 Amemiya et al.
2015/0228205 A1* 8/2015 Koskimaki ..... G09B 23/288 600/301
2017/0035650 A1* 2/2017 Taylor ..... A61H 31/005

OTHER PUBLICATIONS

European Search Report dated Apr. 20, 2018, European Application No. 15861192.1, filed Nov. 18, 2015.

* cited by examiner

COMPONENTS OF CPR MACHINE

CPR MACHINE COMPONENTS WITH CAMERA ATTACHED TO RETENTION STRUCTURE

IMAGE OF PATIENT IN RETENTION STRUCTURE

COMPONENTS OF CPR MACHINE WITH CAMERA & LIGHT SOURCE TO ASSIST IMAGING

COMPONENTS OF CPR MACHINE WITH TWO CAMERAS

COMPONENTS OF CPR MACHINE WITH CAMERA & MIRROR

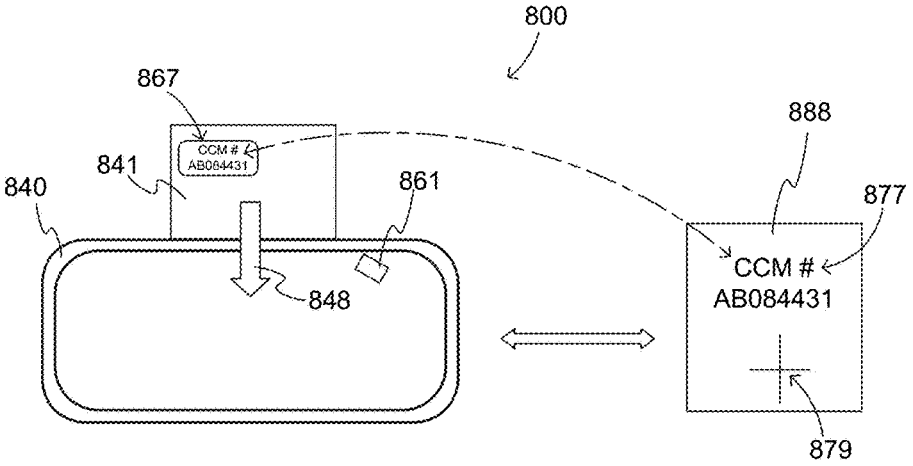
FIG. 8 COMPONENTS OF CPR MACHINE & ASSOCIATED SIGHT TARGET
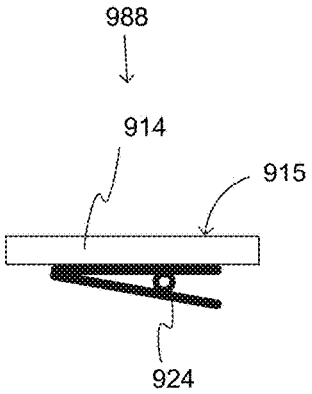
FIG. 9
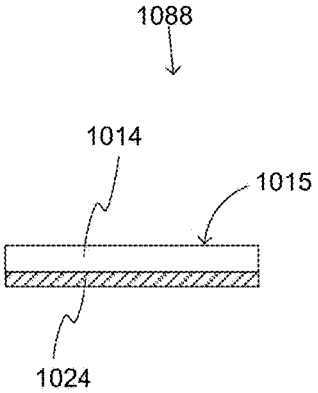
FIG. 10

IMAGE WITH VIEW OF SIGHT TARGET

LATER IMAGE WITH VIEW OF SIGHT TARGET

*METHODS FOR CPR MACHINE WITH CAMERA*

FIG. 14 *RESCUER METHODS*

CPR PATIENT WITH
MULTIPLE SIGHT TARGETS

*COMPONENTS OF CPR MACHINE*

CPR MACHINE COMPONENTS WITH ULTRASOUND PROBE ATTACHED TO RETENTION STRUCTURE

CPR MACHINE PISTON & ULTRASOUND PROBE ATTACHED TO PISTON

USER INTERFACE (INPUTS)

ULTRASOUND IMAGE OF PATIENT IN RETENTION STRUCTURE

ULTRASOUND IMAGE OF PATIENT IN RETENTION STRUCTURE

*METHODS FOR CPR MACHINE WITH ULTRASOUND CAPABILITY*

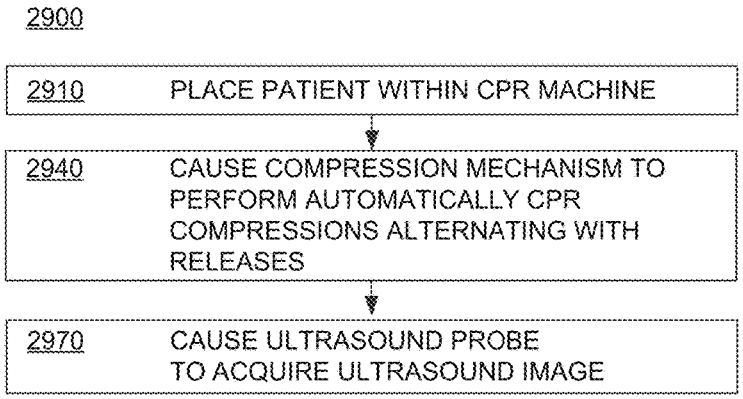
FIG. 29 *RESCUER METHODS*
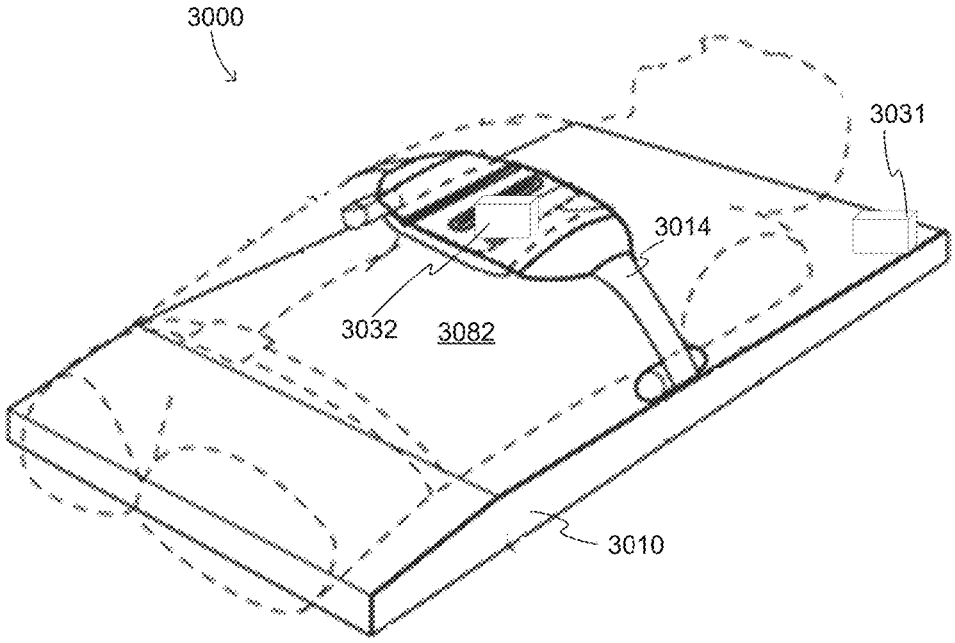
FIG. 30

CPR CHEST COMPRESSION MACHINE WITH CAMERA

CROSS REFERENCE TO RELATED PATENT APPLICATIONS

This patent application claims priority from U.S. Provisional Patent Application Ser. No. 62/082,928, filed on Nov. 21, 2014, the disclosure of which is hereby incorporated by reference.

BACKGROUND

In certain types of medical emergencies a patient's heart stops working, which stops the blood from flowing. Without the blood flowing, organs like the brain will start being damaged, and the patient will soon die. Cardio Pulmonary Resuscitation (CPR) can forestall these risks. CPR includes performing repeated chest compressions to the chest of the patient, so as to cause the patient's blood to circulate some. CPR also includes delivering rescue breaths to the patient, so as to create air circulation in the lungs. CPR is intended to merely maintain the patient until a more definite therapy is made available, such as defibrillation. Defibrillation is an electrical shock deliberately delivered to a patient in the hope of restoring their heart rhythm.

Guidelines by medical experts such as the American Heart Association provide parameters for CPR to cause the blood to circulate effectively. The parameters are for aspects such as the frequency of the compressions, the depth that they should reach, and the full release that is to follow each of them. The depth is sometimes required to exceed 5 cm (2 in.). The parameters also include instructions for the rescue breaths.

Traditionally, CPR has been performed manually. A number of people have been trained in CPR, including some who are not in the medical professions, just in case they are bystanders in an emergency event. Manual CPR might be ineffective, however. Indeed, the rescuer might not be able to recall their training, especially under the stress of the moment. And even the best trained rescuer can become fatigued from performing the chest compressions for a long time, at which point their performance may become degraded. In the end, chest compressions that are not frequent enough, not deep enough, or not followed by a full release may fail to maintain the blood circulation required to forestall organ damage and death.

The risk of ineffective chest compressions has been addressed with CPR chest compression machines. Such machines have been known by a number of names, for example CPR chest compression machines, CPR machines, mechanical CPR devices, cardiac compressors, and so on.

CPR chest compression machines typically hold the patient supine, which means lying on his or her back. Such machines then repeatedly compress and release the chest of the patient. In fact, they can be programmed to automatically follow the guidelines, by compressing and releasing at the recommended rate or frequency, while reaching a specific depth.

The repeated chest compressions of CPR are actually compressions alternating with releases. The compressions cause the chest to be compressed from its original shape. During the releases the chest is decompressing, which means that the chest is undergoing the process of returning to its original shape. This process is not immediate upon release, and it might not be completed by the time the next compression is performed. In addition, the chest may start collapsing due to the repeated compressions, which means that it might not fully return to its original height, even if it had the opportunity.

Some CPR chest compression machines compress the chest by a piston. Some may even have a suction cup at the end of the piston, with which they lift the chest at least during the releases. This lifting may actively assist the chest in decompressing faster than the chest would accomplish by itself. This type of lifting is sometimes called active decompression.

There remain challenges. Sometimes, due to the repeated and forceful compressions, the body's position may shift within the CPR chest compression machine, in which case the compressions may become less effective. The body's shifting, seen from the perspective of the body, can be characterized as the CPR machine shifting, or a piston migrating or walking, etc.

BRIEF SUMMARY

The present description gives instances of CPR chest compression machines, systems, software, and methods, the use of which may help overcome problems and limitations of the prior art.

In embodiments, a CPR chest compression machine includes a retention structure configured to retain a patient's body, and a compression mechanism configured to perform automatically CPR compressions to the patient's chest. The CPR machine also includes a camera coupled to the retention structure or to the compression mechanism. The camera has a field of view that spans at least a certain portion of the patient's body, and is configured to acquire an image of what is spanned by its field of view. The image may be stored in a memory, displayed, transmitted, analyzed to diagnose the patient, detect shifting of the patient within the CPR machine, etc.

In embodiments, a CPR chest compression machine has ultrasound capability integrated partly or fully. In embodiments, a CPR chest compression machine includes a retention structure configured to retain a patient's body, and a compression mechanism configured to perform automatically CPR compressions to the patient's chest. The CPR machine also includes an ultrasound transducer probe coupled to the retention structure or to the compression mechanism. The transducer probe is configured to acquire an ultrasound image of an interior of the patient's body. The ultrasound image may be stored in a memory, displayed, transmitted, analyzed to diagnose the patient, detect shifting of the patient within the CPR machine, etc.

Advantages over the prior art include that the patient may be imaged during the CPR treatment, and thus more about them may become known. Adjustments can be made for that patient's treatment, and better data can be collected for the long term. In some embodiments, imaging may further help detect that the body's position has shifted within the CPR machine, and thus a rescuer may adjust the position accordingly.

These and other features and advantages of this description will become more readily apparent from the Detailed Description, which proceeds with reference to the associated drawings in which:

BRIEF DESCRIPTION OF THE DRAWINGS

FIG. 8 is a diagram of components of an abstracted CPR machine and an associated sight target according to embodiments.

FIG. 9 is a side view of a sample sight target in an embodiment that includes an attaching device.

FIG. 10 is a side view of a sample sight target in an embodiment that includes adhesive material on the back side.

FIG. 29 is a flowchart for illustrating methods according to embodiments.

FIG. 30 is a perspective view of a sample CPR machine with tilt sensors, according to embodiments.

DETAILED DESCRIPTION

As has been mentioned, the present description is about Cardio-Pulmonary Resuscitation ("CPR") chest compression machines, methods and software that can perform automatically CPR chest compressions on a patient. Embodiments are now described in more detail.

Figure 1:
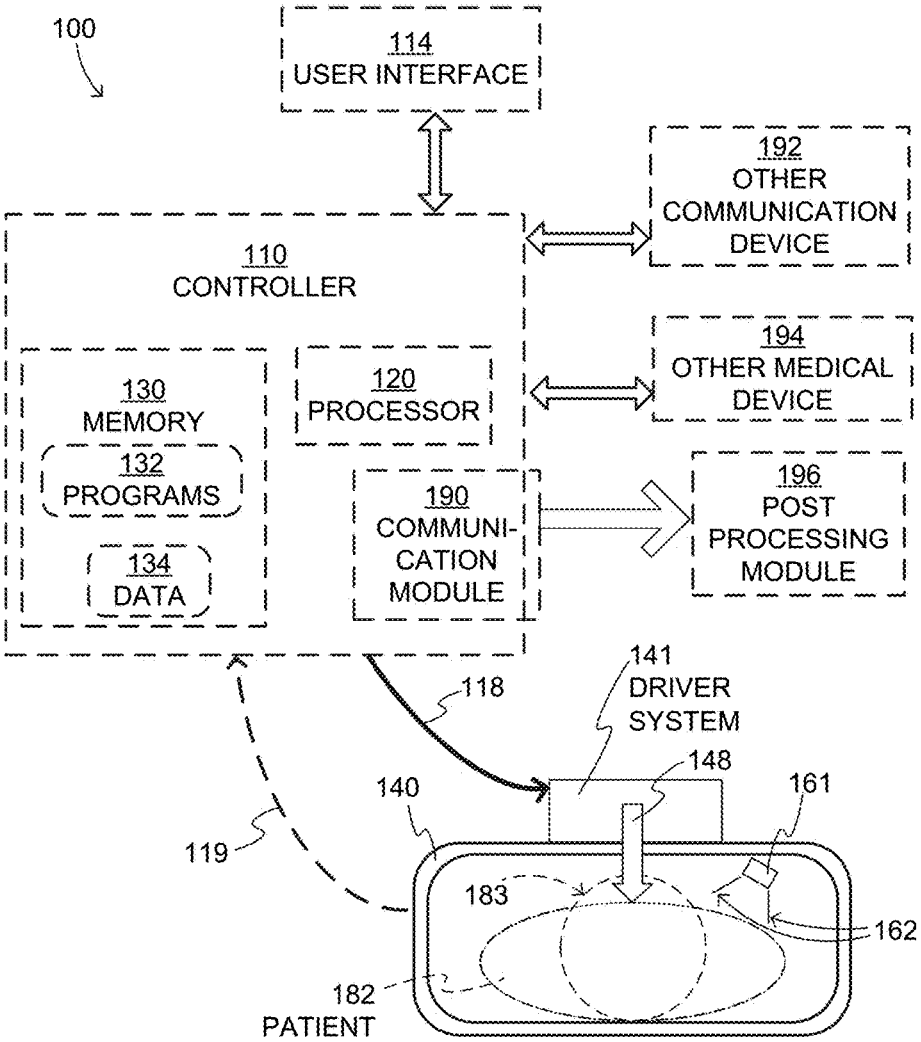
FIG. 1 is a diagram of components of an abstracted CPR machine that includes a camera according to embodiments.

FIG. 1 is a diagram of components 100 of an abstracted CPR machine according to embodiments. The abstracted CPR machine can be configured to perform compressions alternating with releases on a chest of a supine patient 182.

Components 100 include an abstracted retention structure 140 of a CPR chest compression machine. Patient 182 is placed supine within retention structure 140. Retention structure 140 retains the patient's body, and may be implemented in a number of ways. Good embodiments are disclosed in U.S. Pat. No. 7,569,021 to Jolife AB which is incorporated by reference; such embodiments are being sold by Physio-Control, Inc. under the trademark LUCAS®. In other embodiments retention structure 140 includes a belt that can be placed around the patient's chest. While retention structure 140 typically reaches the chest and the back of patient 182, it often does not reach the head 183.

Components 100 also include a compression mechanism 148. Compression mechanism 148 can be configured to perform the compressions to the chest, and then the releases after the compressions.

Components 100 also include a driver system 141. Driver system 141 can be configured to drive compression mechanism 148 automatically. This driving may cause the compressions and the releases to be performed repeatedly.

Compression mechanism 148 and driver system 141 may be implemented in combination with retention structure 140 in a number of ways. In the above mentioned example of U.S. Pat. No. 7,569,021 compression mechanism 148 includes a piston, and driver system 141 includes a rack-and-pinion mechanism. The piston is also called a plunger. In embodiments where retention structure 140 includes a belt, compression mechanism 148 may include a spool for collecting and releasing the belt so as to correspondingly squeeze and release the patient's chest, and driver system 141 can include a motor for driving the spool.

Components 100 may further include a controller 110. Driver system 141 may be controlled by a controller 110 according to embodiments. Controller 110 may include a processor 120. Processor 120 can be implemented in a number of ways, such as with one or more microprocessors, general purpose processors, microcontrollers, Digital Signal Processors (DSPs), Application Specific Integration Circuits (ASICs), programmable logic circuits, programmable logic devices, etc. While a specific use is described for processor 120, it will be understood that processor 120 can either be standalone for this specific use, or also perform other acts, operations or process steps.

In some embodiments controller 110 additionally includes a memory 130 coupled with processor 120. Memory 130 can be implemented by one or more memory chips, volatile memories, non-volatile memories (NVM), read only memories (ROM), random access memories (RAM), magnetic disk storage media, optical storage media, smart cards, flash memory devices, etc. Memory 130 can be thus a non-transitory storage medium that stores programs 132, which contain instructions for machines. Programs 132 can be configured to be read by processor 120, and be executed upon reading. Executing is performed by physical manipulations of physical quantities, and may result in functions, processes, actions, operations and/or methods to be performed, and/or processor 120 to cause other devices or components to perform such functions, processes, actions, operations and/or methods. Often, for the sake of convenience only, it is preferred to implement and describe a program as various interconnected distinct software modules or features, individually and collectively also known as software. This is not necessary, however, and there may be cases where modules are equivalently aggregated into a single program. In some instances, software is combined with hardware in a mix called firmware.

While one or more specific uses are described for memory 130, it will be understood that memory 130 can further hold data 134, such as event data, patient data, data of the CPR machine, and so on. For example, data gathered according to embodiments could be aggregated in a database over a period of months or years, and be used later to search for evidence that one pattern of CPR is more effective (in terms of a criterion) over others, of course correlating with the patient. Data could be de-identified so as to protect the patient's privacy. If so, then what is learned could be used to adapt the devices to employ the more effective pattern either continuously or at least as one of their operating modes.

Controller 110 may include or cooperate with a communication module 190, which may communicate with other modules or functionalities wirelessly, or via wires. Controller 110 may include or be communicatively coupled with a user interface 114, for receiving user instructions and settings, for outputting data, for alerting the rescuer, etc. Accordingly, user interface 114 may include a keyboard, a screen, a touchscreen, a speaker, a microphone, a dial, a knob, a switch, etc.

Communication module 190 may further be communicatively coupled with an other communication device 192, an other medical device 194, and also transmit data 134 to a post-processing module 196. Any of these communications that are wireless may be by Bluetooth, Wi-Fi, cellular, near field, etc. Data 134 may also be transferred via removable storage such as a flash drive. Other communication device 192 can be a mobile display device, such as a tablet or smart phone. Other medical device 194 can be a defibrillator, monitor, monitor-defibrillator, ventilator, capnography device, etc.

In other embodiments, communication module 190 can be configured to receive transmissions from such other devices or networks. Therapy from such other devices, such as ventilation or defibrillation shocks, can be coordinated and/or synchronized with the operation of the CPR machine. For example, the CPR machine may pause its operations for delivery of a defibrillation shock, afterwards detection of ECG, and the decision of whether its operation needs to be restarted. For instance, if the defibrillation shock has been successful, then operation of the CPR machine might not need to be restarted.

Post-processing module 196 may be part of a medical system network in the cloud, a server such as in the LIFENET® system, etc. Data 134 can be sent to module 196 by communication module 190. While in module 196, data 134 can be used in post-event analysis. Such analysis may reveal how the CPR machine was used, whether it was used properly, and to find ways to improve future sessions, etc.

Controller 110 can be configured to control driver system 141 according to embodiments. Controlling is indicated by arrow 118, and can be implemented by wired or wireless signals and so on. Accordingly, compressions can be performed on the chest of patient 182 as controlled by controller 110.

In some embodiments, one or more physiological parameters of patient 182 are sensed, for example measured end tidal CO2, ROSC detection, pulse oximetry, etc. Upon a physiological parameter being sensed, a value of it can be transmitted to controller 110, as is suggested via arrow 119. Transmission can be wired or wireless. The transmitted values may further affect how controller 110 controls driver system 141.

Controller 110 may be implemented together with retention structure 140, in a single CPR chest compression machine. In such embodiments, arrows 118, 119 are internal to such a CPR chest compression machine. Alternately, controller 110 may be hosted by a different machine, which communicates with the CPR chest compression machine that uses retention structure 140. Such communication can be wired or wireless. The different machine can be any kind of device, such as other communication device 192 or other medical device 194. One example is described in U.S. Pat. No. 7,308,304, titled "COOPERATING DEFIBRILLATORS AND EXTERNAL CHEST COMPRESSION MACHINES," the description of which is incorporated by reference. Similarly, user interface 114 may be implemented on the CPR chest compression machine, or on another device.

In embodiments, the compressions are performed automatically in one or more series, and perhaps with pauses between them, as controlled by controller 110. A single resuscitation event for a patient can be sets of such compressions.

Driver system 141 can be configured to drive compression mechanism 148 automatically according to a motion-time profile. The motion-time profile can be such that the driving can cause the compression mechanism to repeatedly perform the compressions and the releases. The chest can be compressed downward from the resting height for the compressions, and then decompress at least partially during the releases. Several of the compressions can thus compress the patient's chest downward from the resting height by at least 1 cm, 2 cm, 5 cm, or even deeper.

Components 100 may further include a main camera 161 that has a main field of view 162. Main camera 161 and its main field of view 162 may be implemented in a number of ways, for example as is well known for digital cameras. Main field of view 162 may span at least a certain portion of the body of patient 182, while the body is retained by retention structure 140. Main camera 161 can be configured to acquire a main image of what is spanned by its main field of view 162. Main camera 161, its main field of view 162, and the main image it can acquire are characterized as "main" only to differentiate from possibly additional cameras according to embodiments. As such, the word "main" might not be used always, for example in instances where only one camera is provided.

Main camera 161 can be coupled to retention structure 140 or to compression mechanism 148. Coupling can be by attaching fixedly, or removably. In some embodiments, main camera 161 can be rotated from where it is attached, so that its main field of view 162 spans a different view, of the patient or the surroundings, etc. An example is now described.

Figure 2:
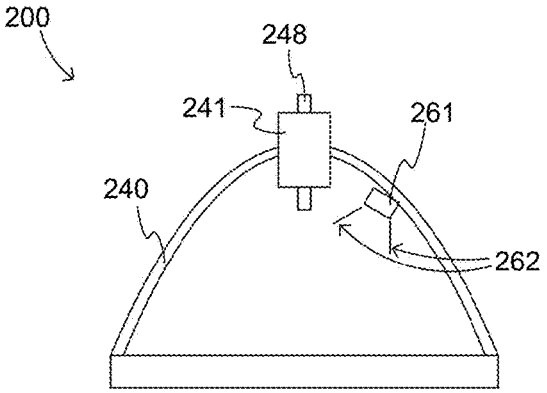
FIG. 2 is a diagram of sample components of a CPR machine where a camera is attached to a retention structure according to embodiments.

FIG. 2 is a diagram of sample components 200 of a CPR machine. Components 200 include a retention structure 240, a driver system 241, and a compression mechanism 248. Components 200 also include a main camera 261 attached to retention structure 240. Main camera 261 has a main field of view 262.

Attaching the main camera to the moving piston is not advantageous for continuously visually monitoring the patient, because of challenges with the resulting main field of view. The lowest point of the piston is intended to be contacting the patient continuously, and therefore the main field of view from there might not be useable. Even higher locations on the piston may result in the main field of view changing at the same rate as the compressions, which may be too fast for a video image.

In some embodiments, the user interface of a CPR machine is configured to receive a visual imaging request. The main image is acquired responsive to the received visual imaging request. An implementation is now described.

Figure 3:
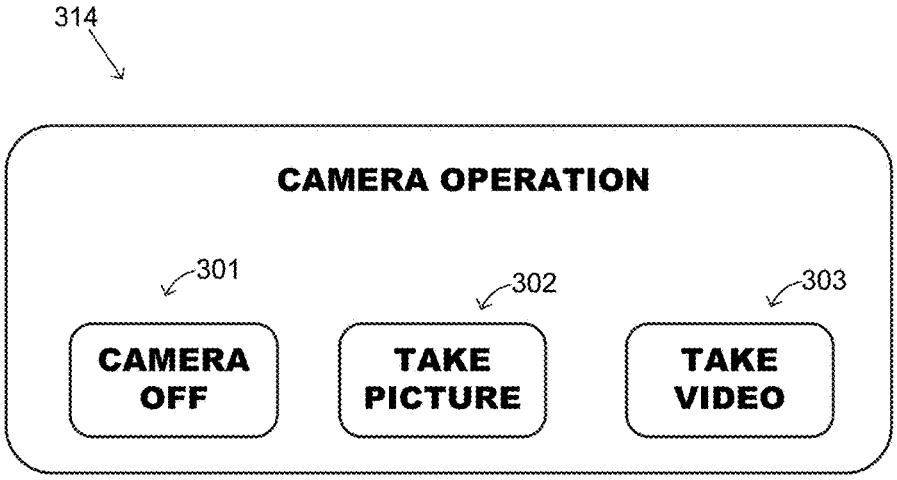
FIG. 3 is a diagram of a sample portion of a user interface according to embodiments.

FIG. 3 shows an example of a user interface 314 that may be provided for the operation of a CPR machine according to embodiments. User interface 314 has actuators 301, 302, 303, which can be physical pushbuttons, buttons on a touchscreen, settings of a dial, knobs, switches, and so on. In this example, the effect of operating actuators 301, 302, 303 is written on them. The main image may be acquired responsive to operating actuator 302 (static image) or actuator 303 (video image). User interface 314 may present further options for further actions, for example further actions that may be performed with the acquired main image.

In some embodiments, a CPR machine additionally includes a screen, for example as part of its user interface 114. The screen can be configured to display a version of the main image. The version of the main image can be the whole main image, a section of the main image, a feature of the main image, a version of the main image with colors changed according to a rule, etc.

Figure 4:
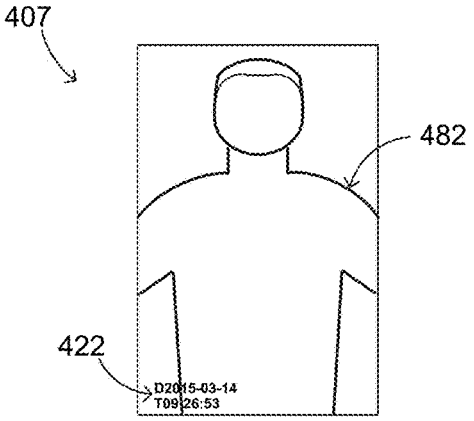
FIG. 4 is a diagram of a sample image that may have been acquired by a camera according to embodiments.

FIG. 4 is a diagram of a rectangular image 407 that may have been acquired by a camera according to embodiments. Image 407 may be what is displayed on a screen, as described above. Image 407 includes a view 482 of the patient.

In some embodiments, a CPR machine additionally includes a time keeping mechanism, such as a clock. The time keeping mechanism may be set externally, and so on. The time keeping mechanism can be configured to generate a time indication. The time indication may include a date and a time.

In some embodiments, a view of the time indication is added to the main image. In the example of FIG. 4, a view 422 of the time indication is added to image 407. The time indication is sometimes called a date stamp, a time stamp, etc.

In some embodiments, a CPR machine may perform further actions with the acquired main image. For example, referring to FIG. 1, memory 130 can be configured to store image data that encode a version of the main image as data 134. Additionally, communication module 190 can be configured to transmit an image signal that encodes a version of the main image. The transmit image of FIG. 4 may be thus received by a remote attendant who may be observing, offer advice, and so on.

In some embodiments, a CPR machine may further include a light source to assist imaging by the main camera. An example is now described.

Figure 5:
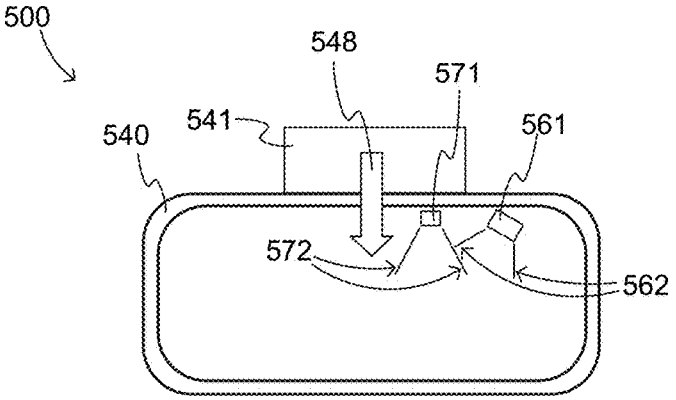
FIG. 5 is a diagram of components of an abstracted CPR machine that includes a camera and a light source to assist imaging by the camera according to embodiments.

FIG. 5 is a diagram of sample components 500 of an abstracted CPR machine. Components 500 include a retention structure 540, a driver system 541, and a compression mechanism 548. Components 500 also include a main camera 561 attached to retention structure 540. Main camera 561 has a main field of view 562.

Components 500 additionally include a light source 571. Light source 571 may be coupled to retention structure 540 or to compression mechanism 548. Light source 571 can be configured to transmit light 572 towards the certain portion of the patient's body that is within main field of view 562, while the patient's body is retained by retention structure 540. Light source 571 may be turned on continuously, or be controlled to be turned on when main camera 561 acquires the main image, etc.

In some embodiments, a CPR machine may further include an auxiliary camera in addition to the main camera. Such may enable imaging from multiple angles. An example is now described.

Figure 6:
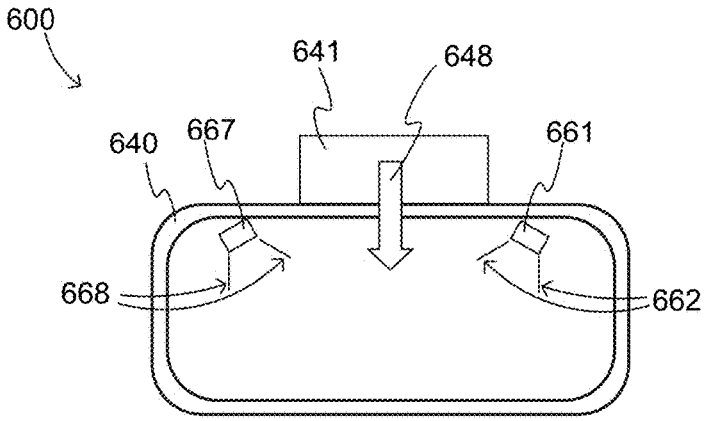
FIG. 6 is a diagram of components of an abstracted CPR machine that includes two cameras according to embodiments.

FIG. 6 is a diagram of sample components 600 of an abstracted CPR machine. Components 600 include a retention structure 640, a driver system 641, and a compression mechanism 648. Components 600 also include a main camera 661 attached to retention structure 640. Main camera 661 has a main field of view 662.

Components 600 additionally include an auxiliary camera 667 that has an auxiliary field of view 668. Auxiliary camera 667 may be coupled to retention structure 640 or to compression mechanism 648. Auxiliary camera 667 can be configured to acquire an auxiliary image of at least a portion of the patient's body, while the patient's body is retained by retention structure 640. The auxiliary image can be combined with or added to the main image, receive a date and time stamp, etc. The operations of main camera 661 and auxiliary camera 667 can be parallel to each other, or one be subordinated to the other, etc.

In some embodiments, a CPR machine may further include a mirror to assist the main camera to image from an additional angle. An example is now described.

Figure 7:
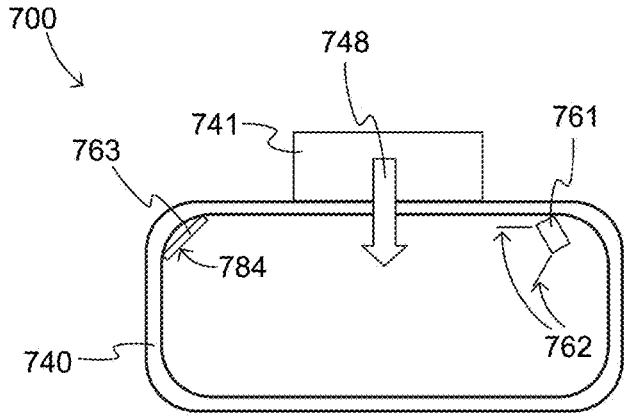
FIG. 7 is a diagram of components of an abstracted CPR machine that includes a camera and a mirror to assist imaging by the camera according to embodiments.

FIG. 7 is a diagram of sample components 700 of an abstracted CPR machine. Components 700 include a retention structure 740, a driver system 741, and a compression mechanism 748. Components 700 also include a main camera 761 attached to retention structure 740. Main camera 761 has a main field of view 762.

Components 700 additionally include a mirror 763, which is coupled to retention structure 740. Mirror 783 is within main field of view 762. Accordingly, main camera 761 can image also through mirror 783, and more particularly through its reflective side 784.

In some embodiments, one or more sight targets are added to the patient in such a way that they are imaged by the main camera. In these embodiments it may be possible to detect a shift of the position of the patient's body within the CPR machine because the sight targets may shift within the main field of view, and thus the main image will be different. Examples are now described.

FIG. 8 is a diagram of sample components 800 of an abstracted CPR machine. Components 800 include a retention structure 840, a driver system 841, and a compression mechanism 848. Components 800 also include a main camera 861 attached to retention structure 840.

The abstracted CPR machine of FIG. 8 has been assigned a serial number for identification purposes, as may happen with a number of medical devices. In this example, the serial number is: "CCM # AB084431". In the particular embodiment of FIG. 8, a label 867 is further attached to driver system 841 and indicates the serial number, although this is not necessary.

The abstracted CPR machine of FIG. 8 further includes a sight target 888. A sight target such as sight target 888 is intended to be imaged by camera 861, by being on the patient (not shown in FIG. 8). One or more sight targets may be provided with a CPR machine for this purpose. When not used, sight target 888 may be stored in a compartment of the CPR machine, or in a compartment of its carrying case, etc.

Sight target 888 includes a display member, whose front side is shown in FIG. 8. In the example of FIG. 8, sight target 888 bears an indication 877 on its front side. Indication 877 is associated with the CPR machine. In this particular embodiment, indication 877 is the serial number of the CPR machine, which is further the same number on label 867. In this particular embodiment, indication 877 is human-readable, but it may be a "smart sticker" by including machine-readable components such as a bar code, passive wire code, RFID, Bluetooth, near-field wireless, Wi-Fi, etc.

Sight target 888 is configured to be placed at a certain location of the patient's body, such that it will become spanned by the main field of view of the main camera, and thus will be imaged. In embodiments where the sight target also bears indication 877, indication 877 also becomes spanned by the main field of view, and thus will be imaged. To enable the imaging, dimensions of the front side of sight target 888 can be a few cm wide by a few cm high. After the session, the one or more sight targets may be removed from the patient, and stored back with the CPR machine.

When imaged, indication 877 helps provide information about the patient. Accordingly, a set of different sight targets may be provided that have different indications. The proper one or more sight targets may be used in a session to communicate the type of patient. For example, there could be stickers for normal sized males, for normal sized females, for children, for extra-large patients, etc. The rescuer would select the appropriate sticker for the patient and apply it to the patient's chest. The CPR machine or other controller module would read the patient type from the smart sticker, for example by analyzing image 407, or from wireless communications, etc. This information would then be used to properly position the CPR machine for that type of patient, set thresholds for determining whether migration has occurred, and may even be used to set parameters for the compressions and decompressions (including active decompressions).

In the example of FIG. 8, sight target 888 also includes aiming marks in the form of cross hairs 879. These can be easily detected within the eventual main image, and therefore shifting may also be detected with higher confidence.

As mentioned above, the sight target can be configured to be placed at a certain location of the patient's body. This can be accomplished by the sight target being made in a number of ways, and two examples are now described.

Referring to FIG. 9, a sample sight target 988 is shown from the side. Sight target 988 has a display member 914 with a front side 915. Indications intended to be displayed, such the aiming marks, are visible on front side 915. Sight target 988 also has an attaching device, which in this case is a clip 924. Sight target 988 can be placed on the patient by using the attaching device to attach the sight target at the certain location. Placement can be on the patient's top garment, if it is worn tightly. If the top garment is loose, then the sight target may move around, and not provide a good reference for the patient's shifting location.

Referring to FIG. 10, a sample sight target 1088 is shown from the side. Sight target 1088 has a display member 1014 with a front side 1015. Sight target 1088 also has an adhesive material 1024 on the back side of display member 1014, which is opposite its front side 1015. Sight target 1088 can be placed on the patient by adhering sight target 1088 at the certain location of the patient's body using adhesive material 1024. If the certain location is where the patient's skin is exposed, then the uncertainty of the device of FIG. 9 is removed. In some instances, to expose the skin, the patient's top garment may be pushed aside or removed. Adhesive material 1024 may be any suitable adhesive material, for example of the type that is used for defibrillation electrodes.

In some embodiments, shifting of the patient's body within the CPR machine may be detected. For some of these embodiments one or more sight targets may be used. As mentioned above, a sight target is configured to be placed at a certain location of the patient's body such that the sight target is spanned by the main field of view of the main camera. The main image may thus include a view of the sight target. Advantageously, it might not be important where exactly the sight targets are indeed attached, because shifting may be detected by a change of their position over time. Examples are now described.

Figure 11:
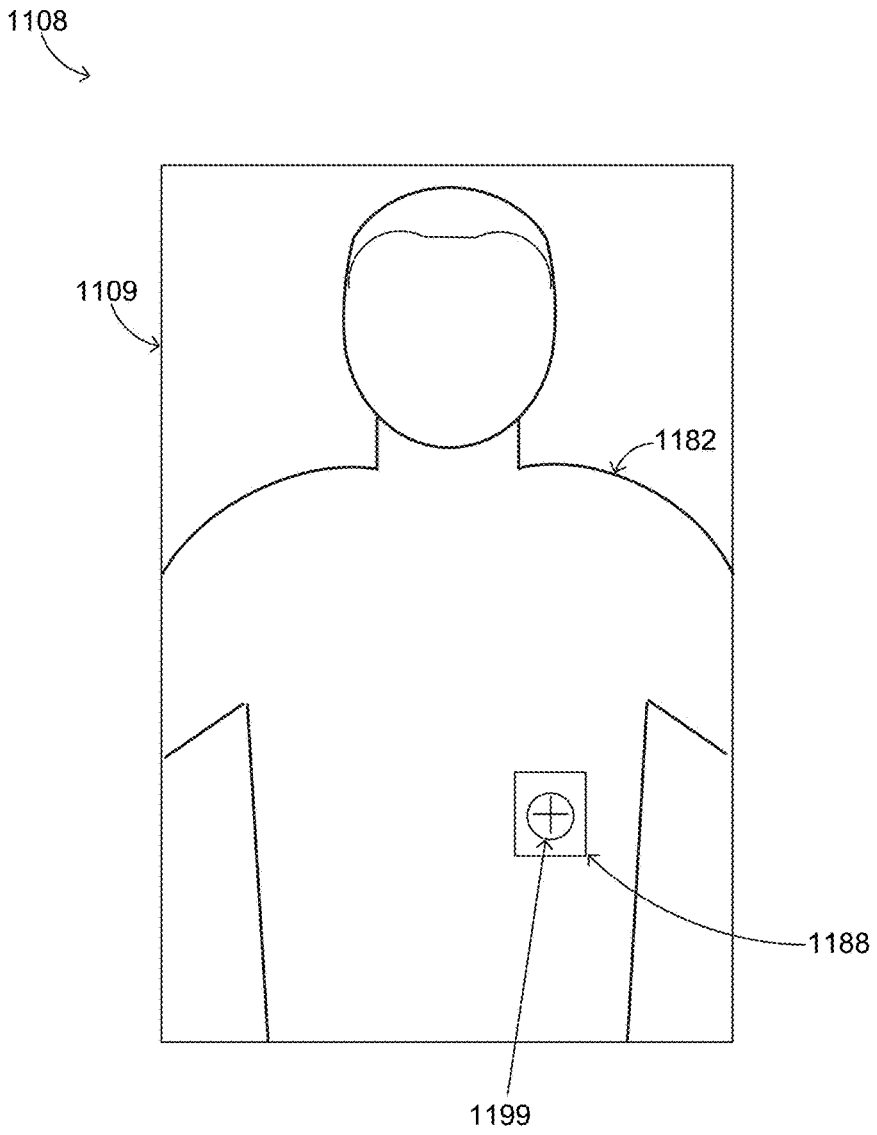
FIG. 11 is a diagram of a sample image that may be displayed on a screen according to embodiments.

FIG. 11 is a diagram of a screen 1108 with boundaries 1109. Screen 1108 displays an image 1182 of a patient that is a version of the main image, plus a view 1188 of a sight target. Here view 1188 is a square with the crosshairs in the middle.

Screen 1108 can be further configured to display a required range superimposed on view 1188 of the sight target. In the example of FIG. 11, the required range is a circle 1199, which is also called a required range circle 1199. Required range 1199 may be defined in different ways. In embodiments, required range 1199 is set with its center at the crosshairs of view 1188, preferably after the patient is initially placed within the CPR machine. The initial placement may be determined by the fact that the rescuer made a corresponding entry in a user interface, or simply by the CPR machine commanded to start the compressions.

In embodiments, memory 130 is configured to store a parameter for the required range. The parameter can be stored as data 134. In the example where the required range is a circle, data 134 can be the coordinates of the center point and the radius of the circle.

Figure 12:
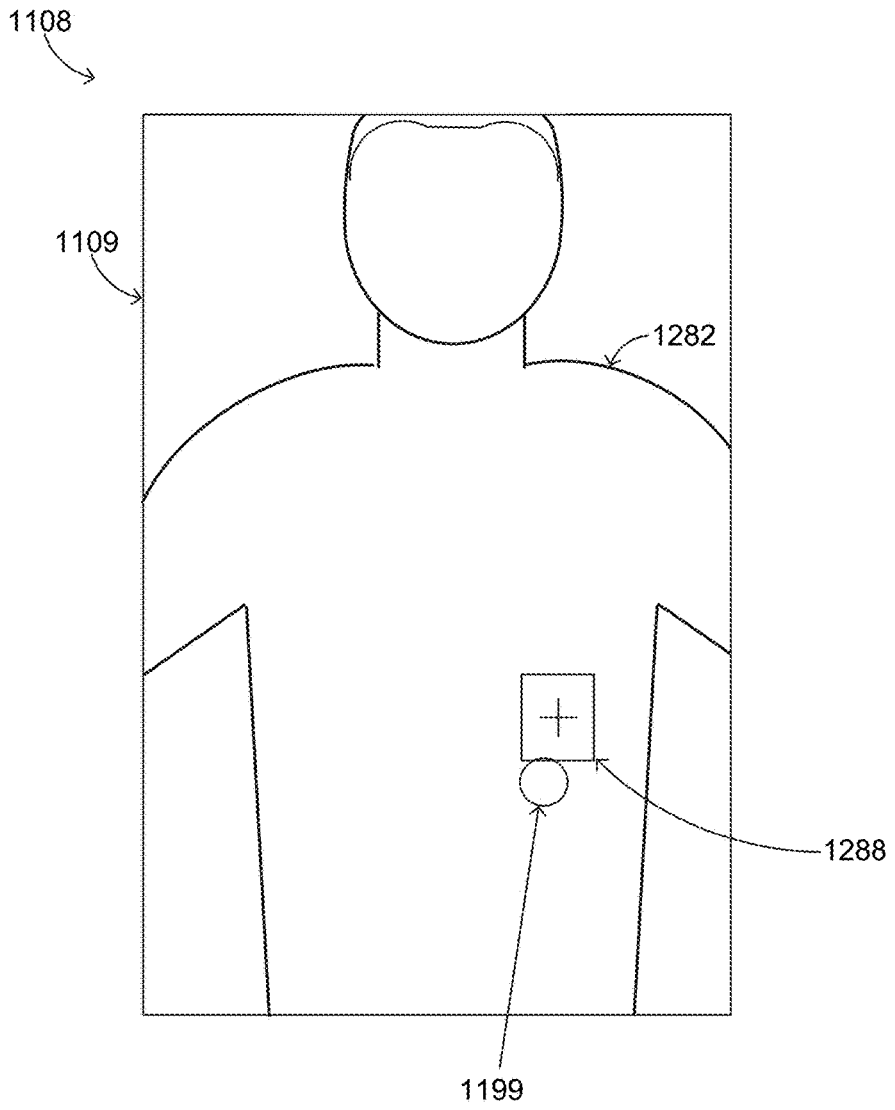
FIG. 12 is a diagram of a sample image that may be displayed on the screen of FIG. 11, but somewhat later than FIG. 11, and from which it may be detected according to embodiments that the patient has shifted within the CPR machine.

FIG. 12 is a diagram of the previously mentioned screen 1108 with boundaries 1109. FIG. 12 may occur later than FIG. 11, for example within the same therapy session. Screen 1108 displays an image 1282 of the patient, plus a view 1288 of the sight target. Image 1282 has been shifted from image 1182, a little upwards and towards the right. The reader may confirm that a portion of the patient's head appears cropped in image 1282, but not image 1182. Shifts like this may be hard to notice when the image of the entire patient is being looked at, especially if these shifts are small.

FIG. 12 also shows required range circle 1199, which has not moved with respect to boundaries 1109 from where it was in FIG. 11. It can be seen more easily that, in FIG. 12, the crosshairs of view 1288 have moved with respect to required range circle 1199, and thus it can be detected that the patient is undesirably shifting with respect to the CPR machine. Detecting can be performed by a rescuer, who may thus adjust the machine upon seeing the display of FIG. 12.

In some embodiments, detecting is performed automatically. For example, the CPR machine may include an image processor as part of controller 110. The image processor can be configured to detect if view 1288 of the sight target is now outside the required range. For instance the image processor can find the position of view 1288 from the image by a mathematical convolution process, and then compare the found position with the coordinates of the required range. The CPR machine could further include a user interface configured to emit an alarm, if the sight target is detected to be outside the required range. For such detecting, therefore, view 1288 can be important, while the remainder of image 1282 is not, and may be omitted.

It will be further appreciated that, once an image processor is involved, the sight targets might become unnecessary. A user interface can be configured to emit an alarm if the main image deviates from a base image by more than a threshold. The main image could be the patient, or features of the patient. Good such features would be of the face, if the head is immobilized with respect to the CPR machine. For example, the nostrils of the patient might be easy features for an image processor to identify in an image. The base image can be the image of the patient when the therapy starts.

Methods and algorithms are further described below. These methods and algorithms are not necessarily purely mathematical, and are configured to address challenges particular to the problem solved, as will be apparent to a person skilled in the art.

This detailed description includes flowcharts, display images, algorithms, and symbolic representations of program operations within at least one computer readable medium. An economy is achieved in that a single set of flowcharts is used to describe both programs, and also methods. So, while flowcharts describe methods in terms of boxes, they also concurrently describe programs.

Methods are now described.

Figure 13:
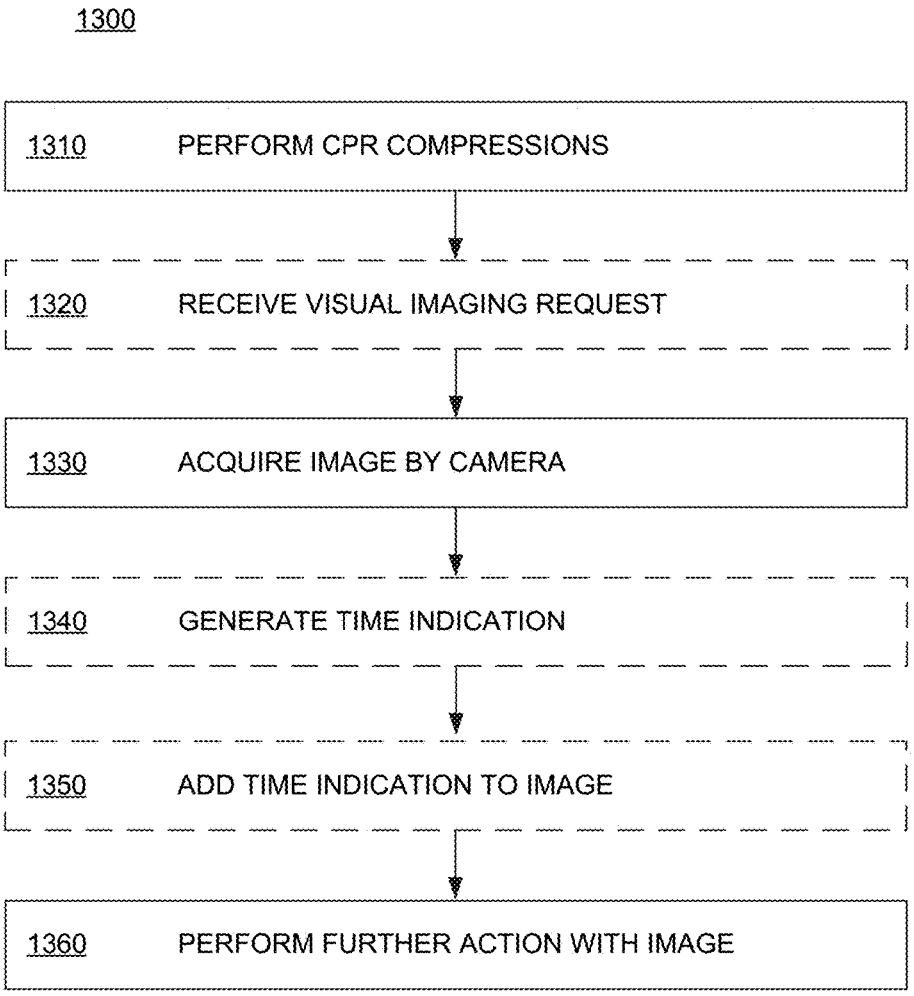
FIG. 13 is a flowchart for illustrating methods according to embodiments.

FIG. 13 shows a flowchart 1300 for describing methods according to embodiments. The methods of flowchart 1300 may also be practiced by embodiments described elsewhere in this document, such as CPR machines equipped as described above.

According to an operation 1310, CPR compressions alternating with releases are performed automatically by a compression mechanism, while a patient's body is retained by a retention structure. The CPR compressions may thus cause the chest to become compressed by at least 2 cm.

According to another, optional operation 1320, a visual imaging request may be received, for example by a user interface.

According to another operation 1330, an image such as a main image may be acquired by a camera such as a main camera, or an auxiliary camera. The image can be of what is spanned by the field of view of the camera. Operation 1330 may be performed automatically. In some embodiments, if operation 1320 has been performed, then the image may be acquired at operation 1330 responsive to the visual imaging request received at operation 1320.

According to another, optional operation 1340, in some embodiments a time indication is generated, for example by a time keeping mechanism. In such embodiments, according to another, optional operation 1350, the time indication may be added to the image.

According to another operation 1360, a further action is performed with the image. Operation 1360 may be implemented in a number of ways. For example, the further action may include displaying a version of the image on a screen of the CPR machine. Or, the further action may include storing image data that encode a version of the image in a memory of the CPR machine. Or, the further action may include transmitting an image signal that encodes a version of the image, for example by a communication module of the CPR machine. Or, the further action may include displaying on the screen a required range for view of a sight target that has been placed on the patient. Or, the further action may include detecting, by an image processor, if the view of a sight target is outside a required range and, if so, emitting an alarm by a user interface. Or, the further action may include emitting, by a user interface, an alarm if the image deviates from a base image by more than a threshold.

Figure 14:
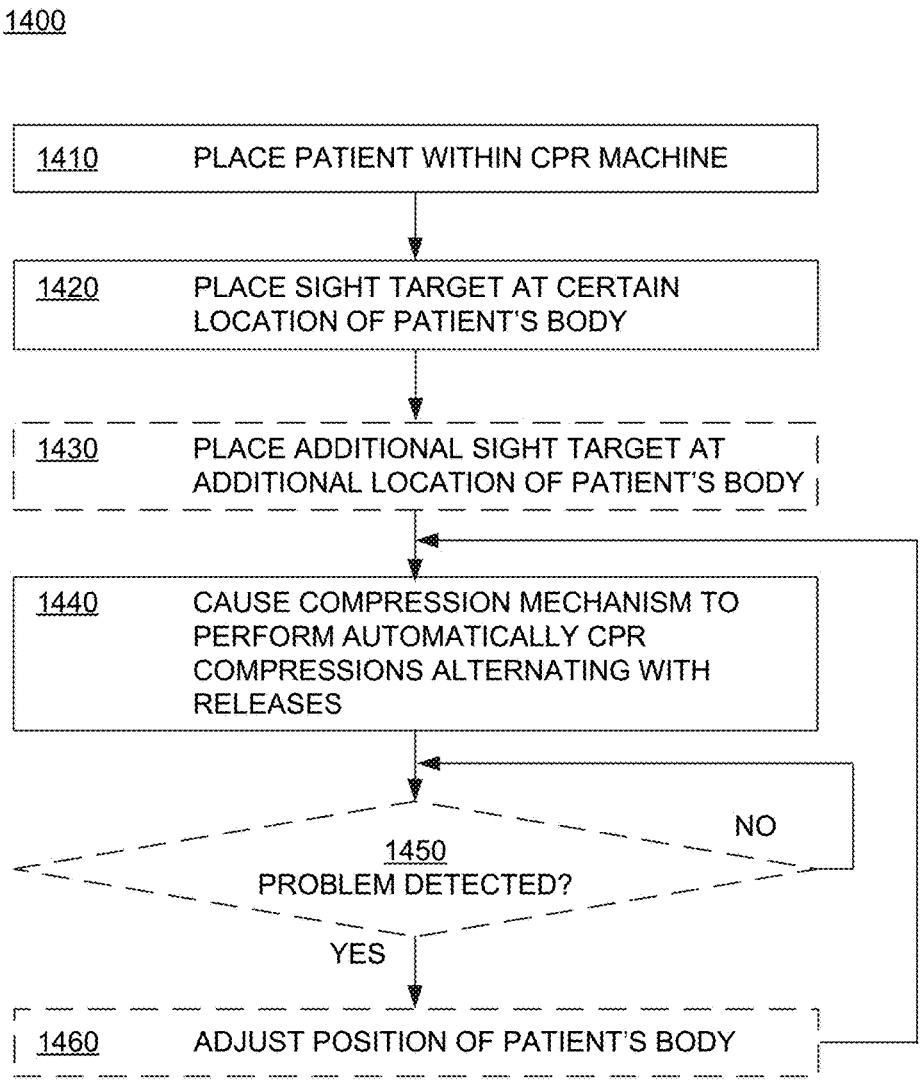
FIG. 14 is a flowchart for illustrating methods according to embodiments.

FIG. 14 shows a flowchart 1400 for describing methods according to embodiments. The methods of flowchart 1400 may also be practiced by rescuers using embodiments described elsewhere in this document.

According to an operation 1410, a patient is placed within a CPR machine. Placement can be such that a body of the patient is retained by a retention structure of the CPR machine, and at least a certain portion of the body is spanned by a main field of view of a main camera of the CPR machine.

According to another operation 1420, a sight target may be placed at a certain location of the body. The location and placing may be such that the sight target is spanned by the main field of view while the body is retained by the retention structure. If the sight target includes an adhesive material, then placing may include adhering the sight target at the certain location using the adhesive material. If the sight target includes an attaching device, then placing may include using the attaching device to attach the sight target at the certain location. If the sight target bears an indication associated with the CPR machine, then the sight target may be placed such that the indication associated with the CPR machine is spanned by the main field of view.

Additional operations may be optionally performed at this stage. For example, if the CPR machine further includes a user interface, the rescuer may further enter in the user interface an acknowledgement that the sight target has been placed.

Figure 15:
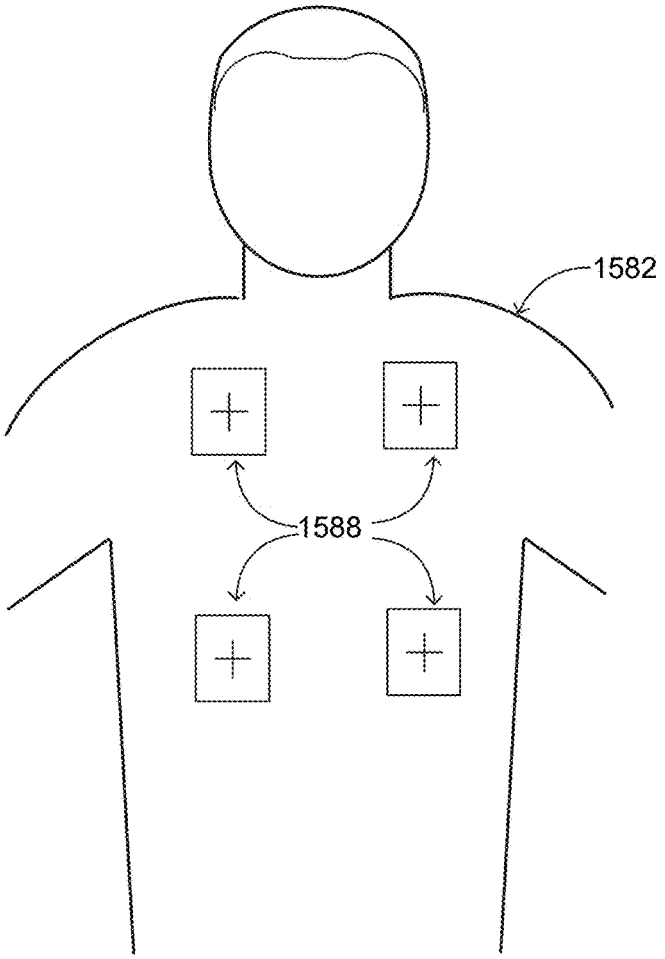
FIG. 15 is a plan view of a portion of a patient's body on which multiple sight targets have been placed according to embodiments.

In embodiments, according to another optional operation 1430, an additional sight target may be placed at an additional location of the body. Placement can be such that the additional sight target is spanned by the main field of view. More sight targets may be placed. For example, FIG. 15 shows a portion 1582 of a patient's body, where four sight targets 1588 have been placed. As can be seen, in the example of FIG. 15 sight targets 1588 include cross hairs, similarly with cross hairs 879 of sight target 888.

Returning to FIG. 14, according to another operation 1440, the compression mechanism of the CPR machine may be caused to perform automatically CPR compressions alternating with releases to a chest of the patient. This may be accomplished by actuating an appropriate actuator of User Interface 114, which could be done by pushing a START button.

In embodiments, the main camera of the CPR machine acquires a main image of what is spanned by the main field of view, while the body is retained by the retention structure. The main camera may be operating automatically, or the rescuer may cause it to acquire the main image.

Once imaging starts, it may be confirmed in a number of ways. For example, the rescuer may place their smartphone within the main field of view of the main camera. The smartphone may show the time that can be used as a record in addition to time kept by controller 110. The main image may be used in a number of ways, for example it may be stored in a memory, displayed, transmitted, or analyzed to diagnose the patient. For example, it may be detected that, due to the CPR machine operating and enough blood flow having been thus restored, the patient has regained consciousness, even though the heart is not operating.

According to another, optional operation 1450, the rescuer determines whether a problem has been detected from the main image. The problem may be, for example, that the patient's body has been detected to have shifted within the CPR machine.

The rescuer might know there is a problem in a number of ways. In some embodiments, the CPR machine detects internally such problems, for example as described above. The CPR machine may further include a user interface configured to emit an alarm if such a problem is detected, which the rescuer could perceive. Then the body's position is adjusted in response to the alarm emitted by the user interface. In some embodiments, the main image includes a view of the sight target. In addition, the CPR machine further includes a screen configured to display the view of the sight target, plus a required range superimposed on the view of the sight target. In such embodiments the rescuer may view on the screen the displayed required range and the view of the sight target, and detect that a problem exists if the view of the sight target is outside the displayed required range.

If at operation 1450 no problem has indeed been detected, execution may return to operation 1450 or proceed elsewhere. If, however, at operation 1450 a problem has indeed been detected then according to another, optional operation 1460, the rescuer may further adjust a position of the body within the retention structure in response to the detected problem. For example, then the body's position may be adjusted in response to the view of the sight target being outside the displayed required range. Before doing so, the rescuer might first turn off the compression mechanism and, after adjusting, repeat operation 1440.

In other embodiments, a pad or film or sheet is attached to the patient's chest. On its front side, the pad or film or sheet can have markings that of where a piston would contact the patient's chest, and any shifting maybe detected this way. On its back side, the pad or film or sheet can have adhesive, for example of the type used in defibrillation electrodes. Examples are now described.

Figure 16A:
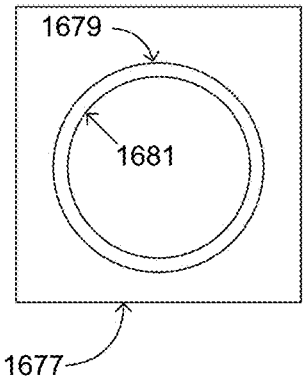
FIG. 16A is a plan view of a sample pad that may be initially placed on the patient's chest for aiming a piston according to its footprint according to embodiments.
Figure 16B:
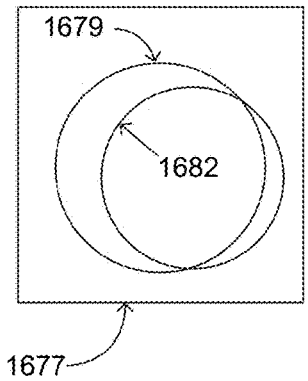
FIG. 16B is a plan view of how the footprint of a piston on the pad of FIG. 16A may become misaligned if the patient shifts within the CPR machine.

FIG. 16A is a plan view of a pad 1677 that may be initially placed on and attached to the patient's chest, for aiming a piston according to embodiments. Instead of a pad 1677, other materials could be used, such as a film or a sheet. Pad 1677 has an aiming mark 1679 that is a circle barely larger in diameter than the footprint 1681 of a suction cup that is attached to a piston. A rescuer may then be able visually align the suction cup to the proper position during initial placement. The rescuer may be able to detect when the CPR machine has migrated, because he would see the view of FIG. 16B, where new footprint 1682 is misaligned from aiming mark 1679. Additionally, an adhesive may be added to the back side of pad 1677, to the suction cup, or to both, so as to increase the "anchoring" of the suction cup to the patient's chest and help reduce migration.

Figure 17:
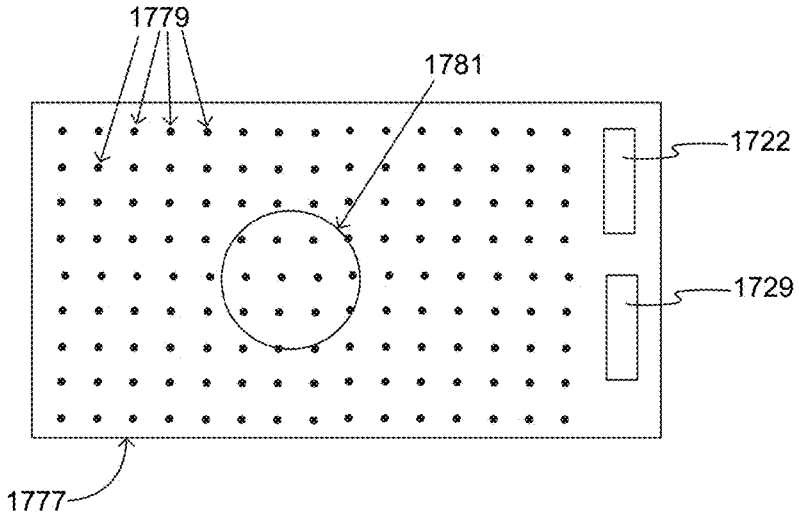
FIG. 17 is a plan view of a sample sheet that may be initially placed on the patient's chest, and which has arrayed piezoelectric detectors for detecting where a piston compresses the patient according to embodiments.

FIG. 17 is a plan view of a sheet 1777 that may be initially placed on and attached to the patient's chest. Sheet 1777 has arrayed piezoelectric detectors 1779 operated by a battery 1722. Piezoelectric detectors 1779 are configured to detect when they are pressed, and this is how a footprint 1781 of a suction cup can be detected. Sheet 1777 may have an output interface port 1729. Alternately, sheet 1777 may be connected with a multi-wire cable to the CPR machine, which in turns provides power, performs the detection, etc.

The placement of the patient within the CPR machine with a piston results in "aiming" the piston to a place on the chest. The language of "aiming" is used, but it should be remembered that aiming is typically accomplished by moving the patient, not the CPR machine that includes piston. Aiming is accomplished with the initial positioning. If the patient's position shifts, then the patient's position may be adjusted to restore the aiming. This type of aiming is different from what is accomplished by aiming marks 879. Aiming marks 879 facilitate detecting shifting with the passage of time; their initial placement may or may not be at a critical location, and in fact it is best if they are not interfering with the suction cup.

The initial aiming may be accomplished by projecting light onto the patient. This can be accomplished in a number of ways.

In one aspect, a high-intensity light source is mounted to the CPR machine above the suction cup, so that suction cup casts a sharp shadow that the rescuer can readily see to use in aiming the suction cup on the patient's chest. For example, the light source may be mounted on the compression mechanism, on the retention structure, etc.

In another aspect, a laser or other high intensity light source is positioned above the suction cup, which is made of a material that allows sufficient light to be transmitted through the suction cup onto the patient's chest. This light can be used by the rescuer to aim the suction cup on the patient's chest. In a further enhancement, the portion of the suction cup through which the light is transmitted may include a pattern or hologram that uses the light to project an image on the patient's chest. The pattern can be cross hairs, a target, and so on.

In a further enhancement to save power in battery operated CPR machines, the light source may provide a flashing light instead of a constant light. For use in dark environments (e.g., at night, or in an unlit area), the light source may provide a constant "white" light with a flashing colored light that assists the rescuer in positioning the suction cup as in the previous paragraph.

In some embodiments, a sight target with cross hairs may be placed at the exact location of the chest where it is desired for the piston to impact. Then a light pattern can be projected from the CPR machine down to the patient's chest, and the patient may be moved so that the cross hairs are at the light pattern.

In some embodiments, CPR machines have ultrasound capabilities, for example for imaging the body. Such ultrasound capabilities can be implemented by integrating one or more of the components of an ultrasound system with those of a CPR machine. Examples are now described.

Figure 18:
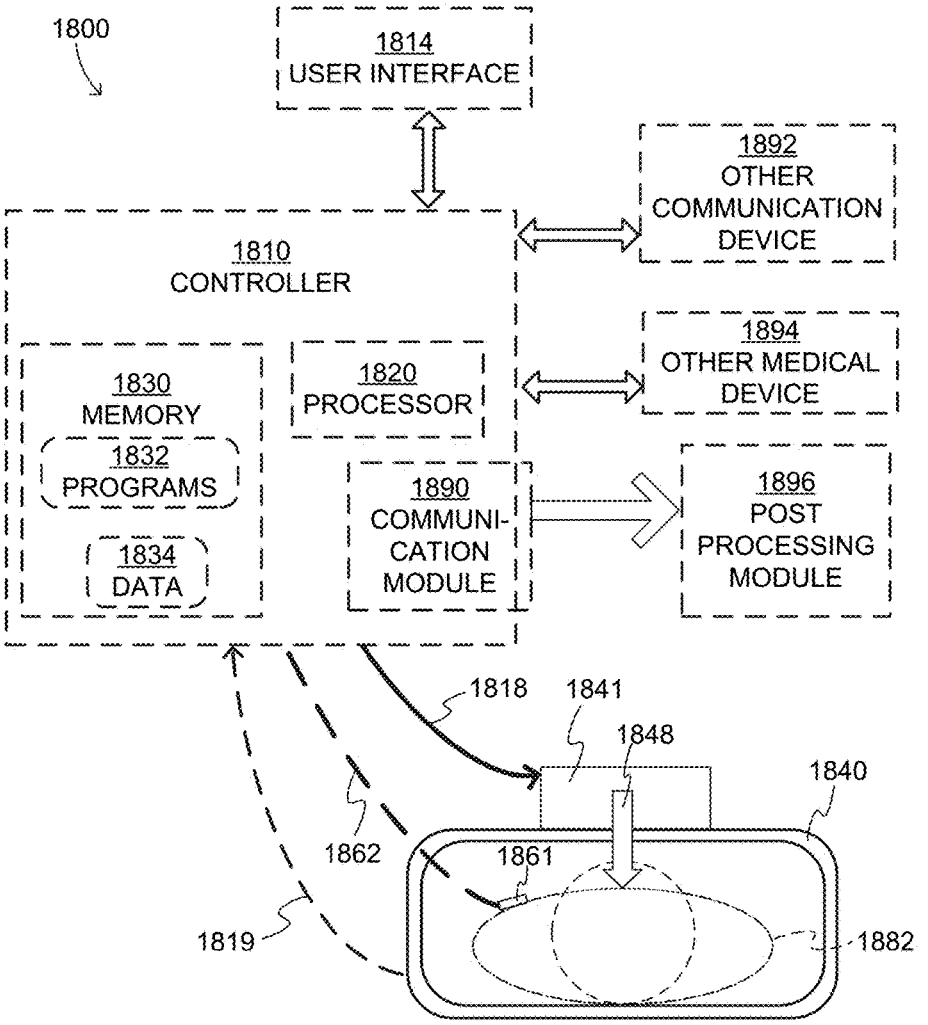
FIG. 18 is a diagram of components of an abstracted CPR machine that includes an ultrasound transducer probe according to embodiments.

FIG. 18 is a diagram of components 1800 of an abstracted CPR machine according to embodiments. The abstracted CPR machine can be configured to perform compressions alternating with releases on a chest of a supine patient 1882. It will be recognized that FIG. 18 includes many components similar to those of FIG. 1, operating similarly or for parallel functions.

Components 1800 include an abstracted retention structure 1840, which can be similar to retention structure 140. Components 1800 also include a compression mechanism 1848 and a driver system 1841, which can be similar to compression mechanism 148 and driver system 141 respectively.

Components 1800 may further include a controller 1810 that is configured to control driver system 1841 according to embodiments, and can be partly as controller 110. Controller 1810 may include a processor 1820 and a memory 1830, which can be implemented similarly with processor 120 and memory 130. Memory 1830 can thus store programs 1832 and data 1834, similarly to what was described for programs 132 and data 134, but of course adapted for the purposes of the embodiments of FIG. 18.

Controller 1810 may include or cooperate with a communication module 1890, which can be as described for communication module 190. Controller 1810 may include or be communicatively coupled with a user interface 1814, which can be as described for user interface 114.

Communication module 1890 may further be communicatively coupled with an other communication device 1892, an other medical device 1894, which can be as described for communication device 192 and other medical device 194, respectively. Communication module 1890 may also transmit data 1834 to a post-processing module 1896, which can be as post-processing module 196.

In other embodiments, communication module 1890 can be configured to receive transmissions from such other devices or networks. Therapy from such other devices, such as ventilation or defibrillation shocks, can be coordinated and/or synchronized with the operation of the CPR machine, for example as described previously.

Controller 1810 can be configured to control driver system 1841 according to embodiments. Controlling is indicated by arrow 1818, and can be implemented by wired or wireless signals and so on. Accordingly, compressions can be performed on the chest of patient 1882 as controlled by controller 1810.

In some embodiments, one or more physiological parameters of patient 1882 are sensed, and values of them can be transmitted to controller 1810, as is suggested via arrow 1819. Transmission can be wired or wireless. The transmitted values may further affect how controller 1810 controls driver system 1841.

In embodiments, the compressions are performed automatically in one or more series, and perhaps with pauses between them, as controlled by controller 1810. Driver system 1841 can be configured to drive compression mechanism 1848 automatically according to a motion-time profile, similarly for what was written for the system of FIG. 1.

In embodiments, one or more components of an ultrasound system may be integrated with those of a CPR machine. For example, an ultrasound transducer probe 1861 may be coupled to retention structure 1840 or to compression mechanism 1848. Ultrasound transducer probe 1861 may also be called transducer probe 1861. Transducer probe 1861 can be configured to acquire an ultrasound image of an interior of the body of patient 1882, while the body is retained by retention structure 1840.

Transducer probe 1861 can be a component of an ultrasound system that sends the sound waves into the body, and receives the sound waves reflected by the interior of the body. The sound waves can be of a frequency that is too high to be heard by the human ear. Another component can be a processor that drives transducer probe 1861, controls power distribution, assembles the ultrasound image from the received reflected sound waves, controls the peripherals, and so on. One more component can be a pulse controller unit that controls the amplitude, frequency and duration of pulses emitted from transducer probe 1861. Other components are for input and output, and can be integrated with user interface 1814. For example, the acquired ultrasound image may be displayed on a screen of user interface 1814.

Transducer probe 1861 may be operated with or without a person specially operating it to acquire the ultrasound image. The field of view of transducer probe 1861 can be adjusted depending on the organ(s) being imaged, perhaps with multiple crystal elements for beam-steering, etc. For such an automatic operation, care should be taken to implement cautions that a human operator might know to do. For example, transducer probe 1861 need not be turned on all the time, but only at times of imaging, so as to prevent unnecessarily prolonged exposure, etc. In addition, ordinary care for ultrasound imaging may be applied. For example, the portion of the skin that will contact the probe may be exposed, and a jelly may be applied to it. The jelly may be mineral oil-based, and is intended to eliminate any air between the ultrasound probe and the skin, so as to help pass the sound waves into the body.

Transducer probe 1861 may be coupled to the remainder of the CPR machine in a number of ways. In some embodiments, transducer probe 1861 is coupled to retention structure 1840 or to compression mechanism 1848 via a cable 1862. The other end of cable 1862 can be coupled to controller 1810, which may include a controller for the ultrasound system. A wireless connection may be used instead of cable 1862. Additional embodiments are now described.

Figure 19:
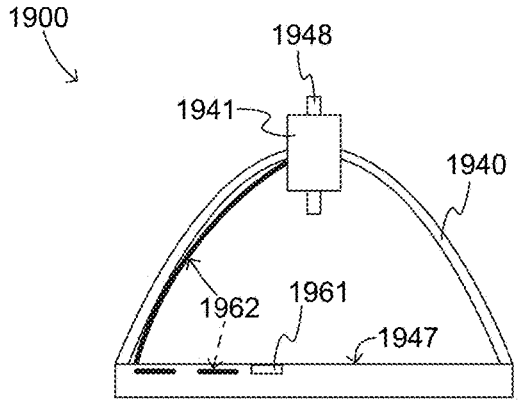
FIG. 19 is a diagram of sample components of a CPR machine where an ultrasound transducer probe is attached to a retention structure according to embodiments.

FIG. 19 is a diagram of sample components 1900 of a CPR machine. Components 1900 include a retention structure 1940 that includes a backboard 1947, a driver system 1941, and a compression mechanism 1948. Components 1900 also include a transducer probe 1961 coupled to retention structure 1940. A cable 1962 is shown partly embedded within backboard 1947, and partly outside retention structure 1940.

Transducer probe 1961 may be coupled to retention structure 1940 in a number of ways. In the shown embodiment, retention structure 1940 includes backboard 1947, and ultrasound transducer probe 1961 is coupled to backboard 1947. It can be embedded in backboard 1947. It can be partly embedded in backboard 1947, and partly protrude from a local plane of backboard 1947 so as to press somewhat into the back of the supine patient for more reliable imaging.

Figure 20:
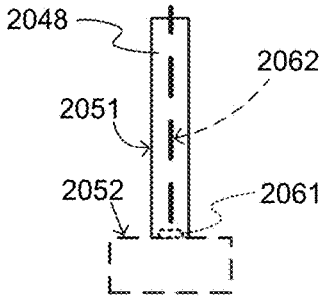
FIG. 20 is a diagram of a sample compression mechanism of a CPR machine where an ultrasound transducer probe is attached to a piston according to embodiments.

FIG. 20 is a diagram of a compression mechanism 2048 of a CPR machine. Compression mechanism 2048 includes a piston 2051 and an optional suction cup 2052. An ultrasound transducer probe 2061 is coupled to piston 2051, which is hollow or includes a groove. A segment of a cable 2062 is located within piston 2051.

The embodiment of FIG. 19 is preferred over that of FIG. 20 if an adhesive material is to be applied to the bottom of piston 2051 in addition to suction cup 2052, because the adhesive material may interfere with the imaging. Nor is it desirable to have a portion of cable 2062 at the top of piston 2051 be free to wave around at the rate of the compressions, which can be at the rate of 100 bpm. Other considerations may prevail, however, for which the embodiment of FIG. 20 is preferred.

In some embodiments, the user interface of a CPR machine is configured to receive an ultrasound imaging request. The ultrasound image is acquired responsive to the received ultrasound imaging request. An example is now described.

Figure 21:
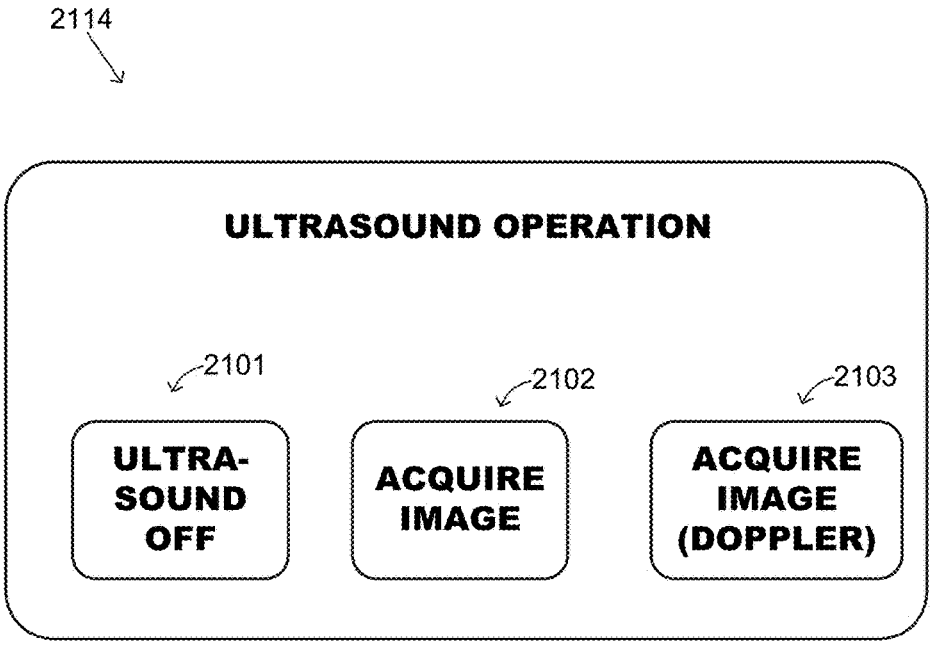
FIG. 21 is a diagram of a sample portion of a user interface according to embodiments.

FIG. 21 shows an example of a user interface 2114 that may be provided for the operation of a CPR machine according to embodiments. User interface 2114 has actuators 2101, 2102, 2103, which can be physical pushbuttons, buttons on a touchscreen, settings of a dial, knobs, switches, and so on. The effect of operating these actuators is written on them. The ultrasound image may be acquired responsive to operating actuator 2102 (ordinary imaging) or actuator 2103 (Doppler imaging).

Operating actuator 2103 may cause the ultrasound image to be acquired by the Doppler effect, as is known in the art of ultrasound imaging. This may be helpful for detecting the blood flow caused by the operation of the CPR machine through organs like the heart and the vascular system. The Doppler technology may be used to measure and indicate blood flow, which in turn can be used by the rescuer to reposition the CPR machine to optimize blood flow to desired portions of the patient's body. For example, the blood flow can be indicated by an audio signal that increases in loudness as the detected blood flow increases. Based on the loudness, a rescuer can then adjust the position of the CPR machine for a maximum loudness, and thereby achieve a maximum blood flow. In other implementations other indications (e.g., visual indicators, voice prompts, etc.) can be used to guide the rescuer to select a position that achieves maximum blood flow. For example, a communications interface may be interconnected with a speaker or display, or other device for providing indications.

In some embodiments, a CPR machine may perform further actions with the acquired ultrasound image. For example, referring to FIG. 1, memory 130 can be configured to store image data that encode a version of the ultrasound image as data 134. Additionally, communication module 190 can be configured to transmit an image signal that encodes a version of the ultrasound image. Accordingly, User interface 2114 may present further options for further actions, for example further actions that may be performed with the acquired ultrasound image.

In some embodiments, a CPR machine additionally includes a screen, for example as part of its user interface 114. The screen may be a touchscreen, or an LCD display or another display. The screen may be mounted on the hood of the CPR machine, so that a rescuer can easily view the imaging of the patient's internal organs and blood vessels. Alternately, a display of a portable device 1892, 1894 may be used. The screen can be configured to display a version of the ultrasound image. The version of the ultrasound image can be the whole ultrasound image, a section of the ultrasound image, a feature of the ultrasound image, a version of the ultrasound image with colors changed according to a rule, etc.

In some embodiments, shifting of the patient's body within the CPR machine may be detected. An example is now described.

Figure 22:
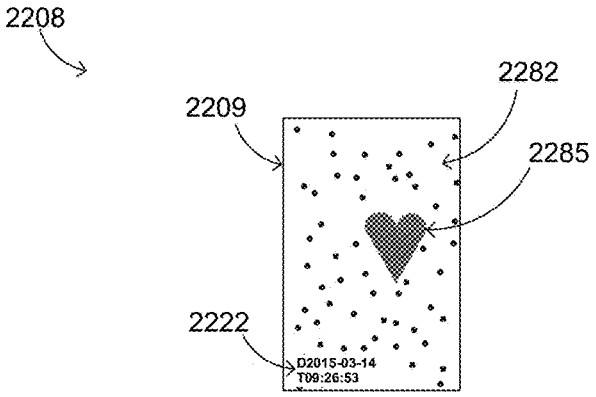
FIG. 22 is a diagram of a sample ultrasound image that may have been acquired by an ultrasound transducer probe according to embodiments.

FIG. 22 is a diagram of a screen 2208 with boundaries 2209. Screen 2208 displays an ultrasound image 2282 of a patient that is a version of the ultrasound image. A view 2285 of the heart is also displayed.

In some embodiments, a view of the time indication is added to the ultrasound image. In the example of FIG. 22, a view 2222 of the time indication is added to what is seen within boundaries 2209.

Figure 23:
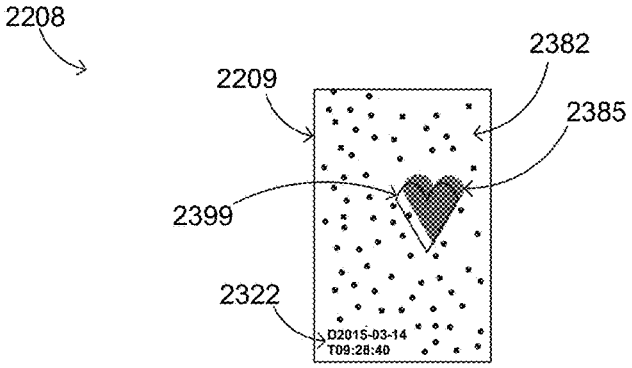
FIG. 23 is a diagram of another sample ultrasound image that may have been acquired after the ultrasound image of FIG. 22 according to embodiments.

FIG. 23 is a diagram of the previously mentioned screen 2208 with boundaries 2209. Screen 2208 displays an ultrasound image 2382 of the patient, which is acquired after ultrasound image 2282 of FIG. 22. A view 2385 of the heart is also displayed, along with an updated view 2322 of the time indication. Image 2382 has been shifted from image 2282, a little upwards and towards the right, probably due to the patient shifting. Ultrasound images tend to include optical noise (shown as dots), and may not be very useful in detecting the shifting, unless one focuses on the shifting of the views of a particular organ or organs. These organs may include major organs, and even bones. In the particular case of FIGS. 22, 23, the particular organ is the heart.

In some embodiments, the screen is configured to display an indication of a proper location of a particular organ of the body. The indication of the proper location may be displayed superimposed on the version of the ultrasound image. In the example of FIG. 23, indication 2399 of a proper location of a particular organ is shown, where the particular organ is the heart. This indication 2399 shows an outline of the heart, and makes it easier to detect the patient shifting. This indication 2399 may be fixed, to assist the initial alignment of the patient, especially in embodiments where the ultrasound probe is fixedly coupled to the retention structure or to the compression mechanism. Or this indication 2399 may be learned, from imaging right before the compressions start, and assuming that placement has been optimal in the beginning. The latter embodiments have the advantage that the outline or other shape of the heart will match exactly that of the patient. In the example of FIG. 23, indication 2399 has been derived from an outline of the heart at the location it was in FIG. 22. Accordingly, indication 2399 shows where view 2285 was, and shifting may be detected.

As mentioned previously, in some embodiments, controller 110 of FIG. 1 also controls the ultrasound imaging. More particularly, a CPR machine may include a driver system that is configured to control the compression mechanism to perform automatically the CPR compressions and the releases. In addition, the CPR machine may include a controller that can be configured to cause the driver system to control the compression mechanism, and to cause the ultrasound transducer probe to acquire the ultrasound image. Moreover, the controller may optionally coordinate the two operations to optimize the therapeutic value of the CPR compressions and the diagnostic value of the ultrasound imaging. Examples are now described.

In some embodiments, the CPR compressions and the releases are performed automatically at a first rate while an ultrasound image is not being acquired. The CPR compressions and the releases are performed at a second rate while the ultrasound image is being acquired. The second rate can be less than the first rate, for example less than half of the first rate. Examples are now described.

Figure 24:
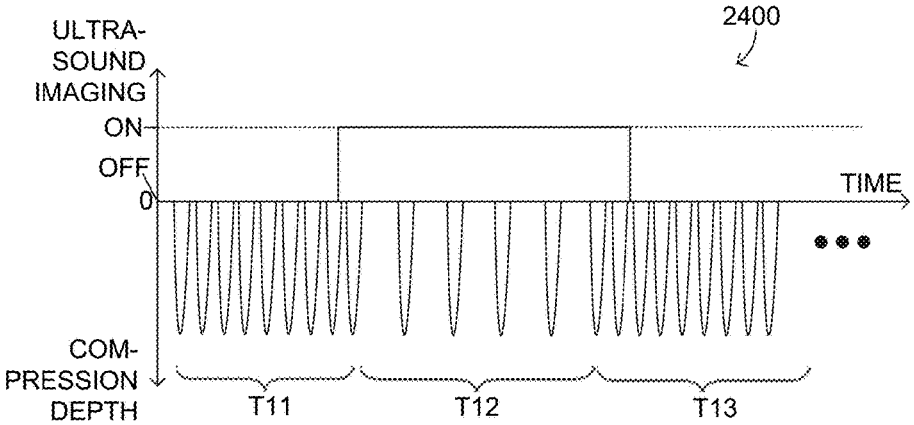
FIG. 24 is a time diagram showing that ultrasound imaging may occur when the CPR compressions and releases are slowed according to embodiments.

FIG. 24 is a time diagram 2400, which shows the depth of the CPR compressions and releases, and when ultrasound imaging may be performed. The CPR compressions and the releases are performed at a first rate, or frequency, during time durations T11 and T13. They are slowed to a second rate during time duration T12. The second rate is less than half the first rate. Imaging may be performed during T12. Imaging may also be performed a little before T12 starts and a little after T12 ends, for better context.

Figure 25:
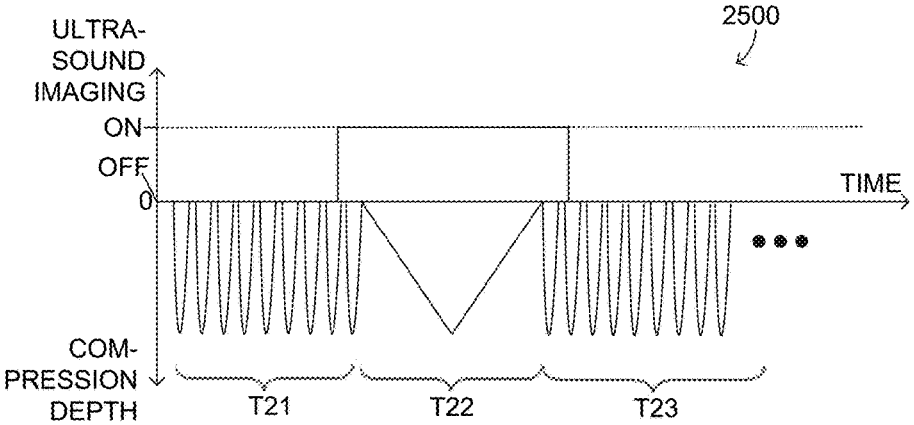
FIG. 25 is a time diagram showing that ultrasound imaging may occur while a very slow CPR compression and release are performed according to embodiments.

FIG. 25 is a time diagram 2500, which shows the depth of the CPR compressions and releases, and when ultrasound imaging may be performed. The CPR compressions and the releases are performed at a first rate, or frequency, during time durations T21 and T23. During time duration T22 a very slow compression and release are performed, which may last a few sec or several sec. Imaging may be performed during T22. Imaging may also be performed a little before T22 starts and a little after T22 ends, for better context.

In some embodiments, the compression mechanism is caused to pause while the ultrasound image is being acquired. An example is now described.

Figure 26:
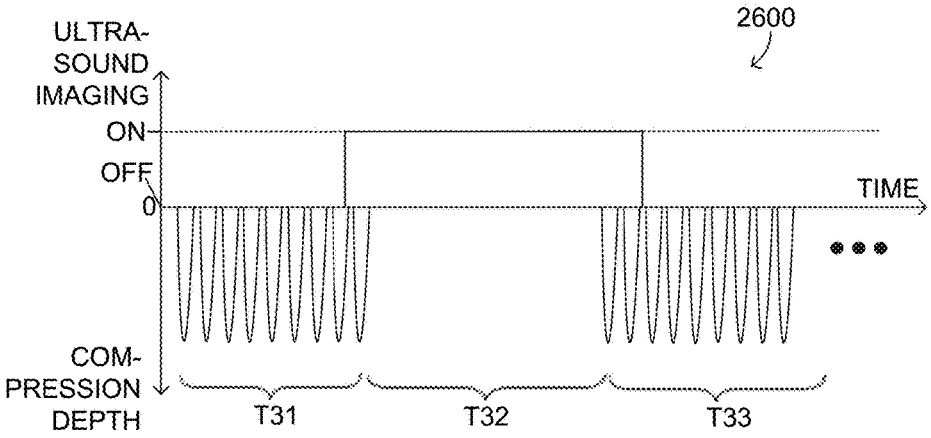
FIG. 26 is a time diagram showing that ultrasound imaging may occur when the CPR compressions and releases have paused according to embodiments.

FIG. 26 is a time diagram 2600, which shows the depth of the CPR compressions and releases, and when ultrasound imaging may be performed. The CPR compressions and the releases are performed during time durations T31 and T33, but are paused during time duration T32. Imaging may be performed during T32.

In the above example, the CPR compressions and releases paused while there was no compression on the body. The depth of compression was zero. In some embodiments, the compression mechanism is caused to pause while the ultrasound image is being acquired, the pause taking place while the chest has been thus caused to become compressed by at least 1 cm. An example is now described.

Figure 27:
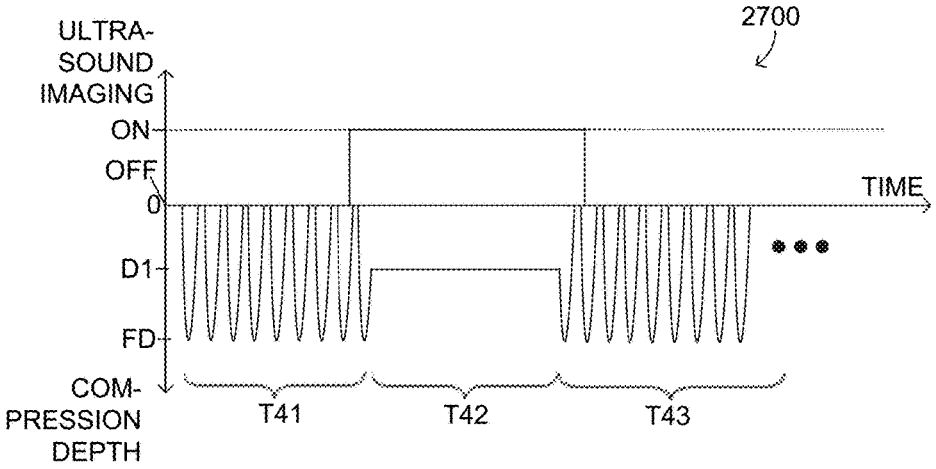
FIG. 27 is a time diagram showing that ultrasound imaging may occur when the CPR compressions and releases have paused at a non-zero depth according to embodiments.

FIG. 27 is a time diagram 2700, which shows the depth of the CPR compressions and releases, and when ultrasound imaging may be performed. The CPR compressions and the releases are performed during time durations T41 and T43, and reach full depth FD. The CPR compressions and the releases are paused during time duration T42, where the compression is at a depth D1. A variety of values may be tried for D1, to study the blood flow of the patient as it settles.

User interfaces may be designed to enable operation such as the above, or be automatic. For example, operating actuator 2102 may automatically cause the compressions to change pace, or pause. In addition, the transient blood flow may be further studied by further controlling the compression mechanism, as seen in the last four diagrams. Observations such as the transient blood flow may suggest a further change in the protocol, for example in the depth of the CPR compressions, their rate, their duty cycle, etc.

The transient blood flow may be studied more reliably if the ultrasound probe is located in the backboard, than at the tip of a piston, which may lose contact with the chest. Even when it is not intended for this contact to be lost, the patient's body may break down from the repeated compressions, and its non-compressed height may be smaller, thwarting the contact required for ultrasound imaging.

Figure 28:
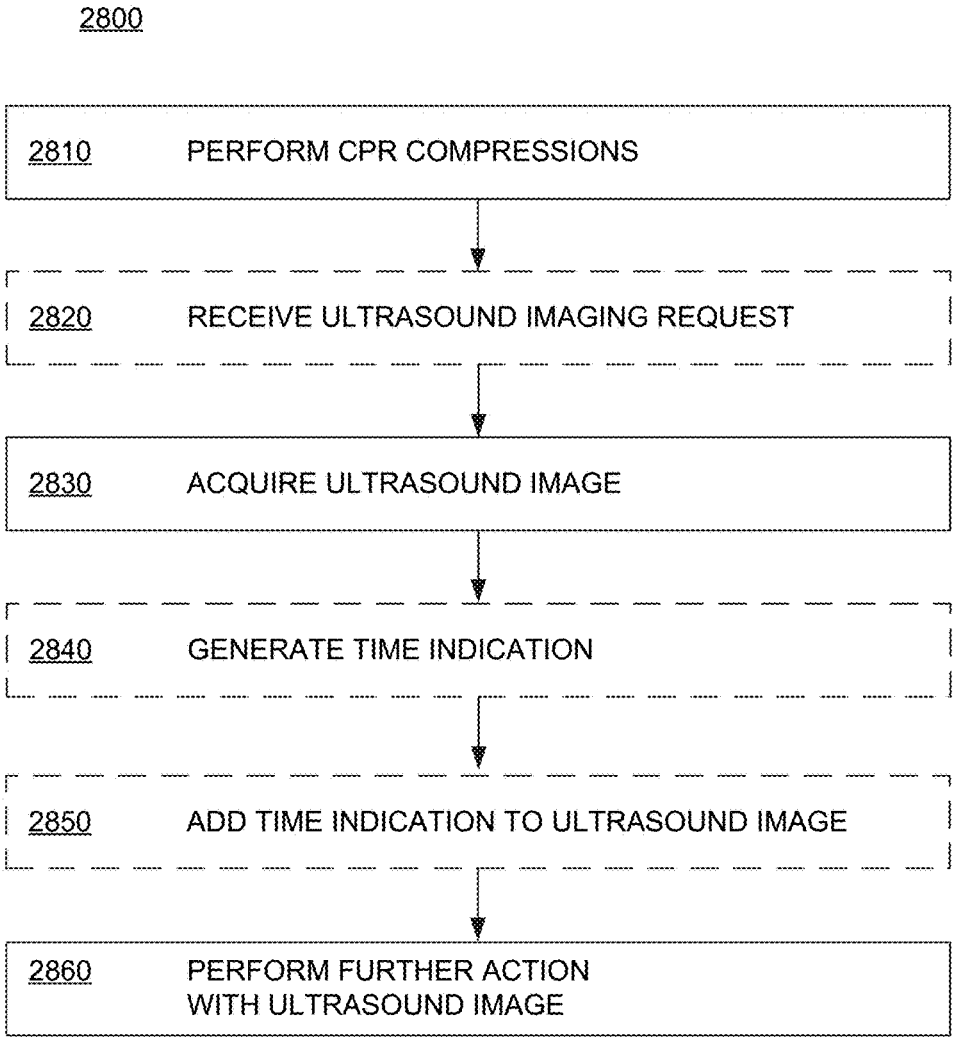
FIG. 28 is a flowchart for illustrating methods according to embodiments.

FIG. 28 shows a flowchart 2800 for describing methods according to embodiments. The methods of flowchart 2800 may also be practiced by embodiments described elsewhere in this document, such as CPR machines equipped as described above.

According to an operation 2810, CPR compressions alternating with releases are performed automatically by a compression mechanism, while a patient's body is retained by a retention structure. The CPR compressions may thus cause the chest to become compressed by at least 2 cm.

According to another, optional operation 2820, an ultrasound imaging request may be received, for example by a user interface.

According to another operation 2830, an ultrasound image may be acquired by an ultrasound transducer probe. The ultrasound image can be of an interior of the patient's body while the body is retained by the retention structure. Operation 2830 may be performed automatically. In some embodiments, if operation 2820 has been performed, then the ultrasound image may be acquired at operation 2830 responsive to the ultrasound imaging request received at operation 2820.

According to another, optional operation 2840, in some embodiments a time indication is generated, for example by a time keeping mechanism. In such embodiments, according to another, optional operation 2850, the time indication may be added to the ultrasound image.

According to another operation 2860, a further action is performed with the ultrasound image. Operation 2860 may be implemented in a number of ways. For example, the further action may include displaying a version of the ultrasound image on a screen of the CPR machine. Or, the further action may include storing image data that encode a version of the ultrasound image in a memory of the CPR machine. Or, the further action may include transmitting an image signal that encodes a version of the ultrasound image, for example by a communication module of the CPR machine. Or, the further action may further include displaying on the screen an indication of a proper location of a particular organ of the body superimposed on the version of the ultrasound image.

In some embodiments, the CPR machine further includes a driver system and controller. Operations may further include causing, by a single controller, the driver system to control the compression mechanism, and the ultrasound transducer probe to acquire the ultrasound image.

FIG. 29 shows a flowchart 2900 for describing methods according to embodiments. The methods of flowchart 2900 may also be practiced by rescuers using embodiments described elsewhere in this document.

According to an operation 2910, a patient is placed within a CPR machine. Placement can be such that a body of a patient is retained by a retention structure of the CPR machine. A portion of the skin that may come in contact with an ultrasound transducer probe may be exposed by removing garments. In addition, a jelly may be applied in advance to the skin, to the probe, or both.

According to operation 2940, a compression mechanism of the CPR machine may be caused to perform automatically CPR compressions alternating with releases to a chest of the patient. This may be accomplished by actuating an appropriate actuator at User Interface 114, for example by pushing a START button.

According to another operation 2970, the ultrasound transducer probe is caused to acquire an ultrasound image of an interior of the body, while the body is retained by the retention structure. This may be a separate operation. Or it may be automated and, for example, take place automatically as part of operation 2940.

In some embodiments, the CPR machine further includes a screen configured to display a version of the ultrasound image, plus an indication of a proper location of a particular organ of the body superimposed on the version of ultrasound image. Another operation could be to view, on the screen, the displayed version of the ultrasound image plus the indication of the proper location. One more operation could be to adjust a position of the body within the retention structure, in response to determining that the displayed version of the ultrasound image deviates from the indication of the proper location.

Other operations may include using a film (or pad or other material) that can be easily detected and distinguished by the ultrasound transducer. For example, the material may be a metal foil. In some embodiments, ECG electrodes may serve as the "film." The ECG electrodes may be integrated into defibrillation pads. This film may be placed on the patient's chest. The CPR machine can be positioned so that the suction cup (or pressure plate) ideally contacts the film so that the compressions are performed at the correct location on the patient's chest. The ultrasound system may monitor the relative positions of the film and the suction cup, to enable a rescuer to determine if the suction cup was properly positioned on the film, or if it is slipping. If so, it may alert, etc.

In another aspect, a CPR machine may include one or more accelerometers to detect sudden changes in the movement of the CPR machine (including selected portions of the CPR machine). The accelerometer data may be stored in the CPR machine or transmitted to other devices or networks for post event analysis. The CPR machine can include a processor that is configured to analyze the accelerometer data to detect whether migration has occurred (e.g., when the suction cup migrates from the chest to the abdomen, an accelerometer on the piston may detect a sudden acceleration), and cause the CPR machine to take a corrective action such as alerting the rescuer to reposition the CPR machine. The processor may also be configured to detect sudden accelerations of the entire CPR machine that might occur during a vehicle accident during transport, which may indicate that migration may have happened. The processor may be configured to take an appropriate corrective action such as, for example, stopping compressions, emitting an alarm, etc.

In this aspect one or more sensors (e.g., accelerometers) can be arranged on a piston type CPR machine and/or patient chest, to monitor the tilt of the CPR machine. In some implementations, a sensor may be placed on the compression mechanism. The CPR machine is configured to detect a sudden change in the tilt, which may indicate that the CPR machine has migrated off of the patient's chest. For further description, US Patent Application 2014/0046228 A1, published on Feb. 13, 2014 is hereby incorporated by reference. In a multiple sensor implementation, changes in tilt at various points of the CPR machine can be used to determine if the tilt is caused by external factors such as during transport rather than migration off of the patient's chest. For example, in implementations using a film as described above, a sensor in a film or pad aligned with the patient's chest may be used to help distinguish between tilt changes caused by transport vs. migration. In migration, the sensor in the film/pad may not detect tilt while a sensor on the CPR machine does; whereas both sensors would detect tilt if the tilt was caused by transport.

In beam-type CPR machines, tilt sensors may be used by arranging them on the beam, in the vertical support or in the back plate.

In belt-type CPR machines, the tilt sensors may be arranged on the base board, the belt and/or the pad. An example is shown in FIG. 30, where a CPR machine 3000 has a base board 3010 for a patient 3082. CPR machine 3000 also has an upper pad 3014, and sensors 3031, 3032. Upper pad 3014 may twist when migration occurs, which may be detected as tilt by sensor 3032 on upper pad 3014. In such a case, the other sensor 3031 would not detect tilt. However, if patient 3082 is tilted during transport, both sensors 3031, 3032 may show tilt. Of course, data generated by tilt sensors may be, communicated, used to emit alarms, stored for post-event analysis, etc.

Patient shifting or slipping may be detected in additional ways. In some embodiments, suitable sensors are integrated in a backboard or a base board of the CPR machine. An example is now described.

Figure 31:
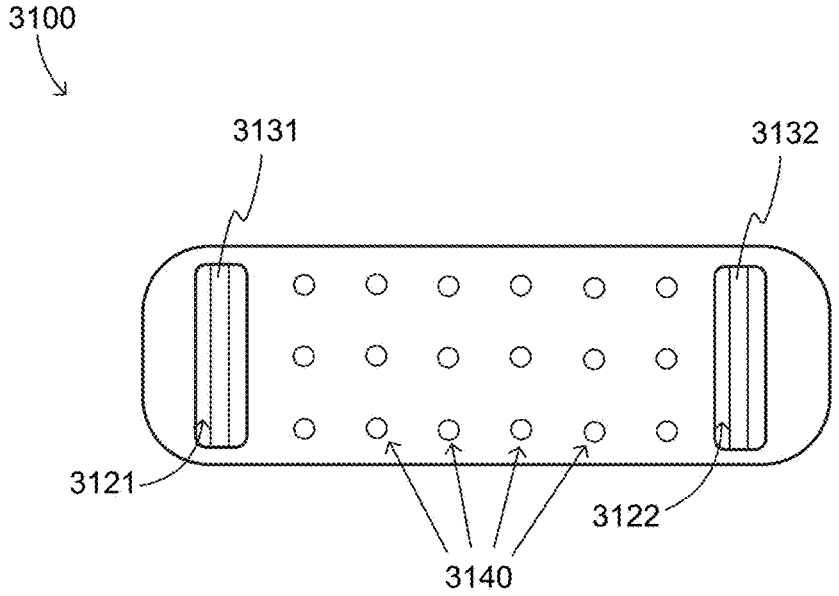
FIG. 31 is a top view of a sample backboard of a CPR machine made according to embodiments.

FIG. 31 shows a sample backboard 3100. This is a backboard that may be used, for example, as the bottom portion in retention structure 240 of FIG. 2. Backboard 3100 has openings 3121, 3122. Handles 3131, 3132 can be within openings 3121, 3122, and be shaped like rods. The remainder of the retention structure may include two support arms that are attached to handles 3131, 3132. Backboard 3100 may optionally be curved, and be of substantially uniform thickness.

Backboard 3100 includes one or more sensors 3140 to detect 2-dimensional movement of the patient's back relative to the backboard 3100. Sensors 3140 can include a cavity with a ball, similarly with how a computer mouse detects and reports its movement. Sensors 3140 can thus be LED or roller-ball based, and can communicate data to a processor or other device using wired or wireless technology. The detected movement could be communicated to the CPR machine's processor or other device, and used to determine if there is migration. Sensors 3140 are shown in an array, but that need not be so. Different numbers of sensors can be used, and in different arrangements.

In most embodiments mentioned above, when the patient has shifted, the adjustment has been to move the patient with respect to the CPR machine. In other embodiments, the CPR machine is modular, and portions of it are moved to better aim the compression mechanism at the patient's chest. Examples are now described.

In some embodiments, the backboard is as backboard 3100, perhaps without sensors 3140. A portion of the remainder of the retention structure may slide along handles 3131, 3132. Accordingly, this can correct for vertical misalignment. More particularly, the support arms can include claw mechanisms for attaching at some point of handles 3131, 3132, while the claw mechanisms are partly within openings 3121, 3122. An adjustment device is included at each attachment point that allows the position of the support arms to be moved along handles 3131, 3132, thereby changing, on the patient's chest, the position of the pressure plate or suction cup that are at the bottom of the piston. This would permit a rescuer to adjust the position of the pressure plate or suction cup to be on the chest without having to slide the patient across the backboard.

Figure 32:
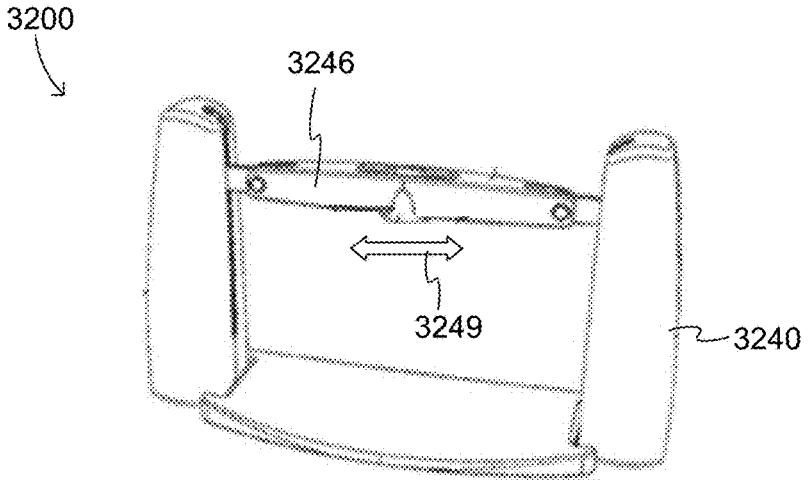
FIG. 32 is a perspective view of a sample CPR machine made according to embodiments.

In some embodiments, the point that compresses the patient may be shifted laterally. For example, in FIG. 32 a beam-type CPR machine 3200 includes a retention structure 3240. CPR machine 3200 can be as disclosed in U.S. patent application Ser. No. 14/018,949 filed Sep. 5, 2013. Retention structure 3240 includes a beam 3246, whose contact point can be moved laterally along the direction of arrow 3249.

For implementation, heavy parts of the compression unit can be placed lower in the beam-type CPR machine (perhaps in the vertical supports near where the back board is attached), which may be less "top heavy" than LUCAS® type devices. A top heavy device may be more prone to movement that changes the angle at which the compressions are applied to the patient's chest, which in turn could result in the CPR machine "walking" down the patient's chest. Thus, locating the heavy components of a beam type CPR machine lower in the device and reducing top heaviness may reduce migration.

In another aspect, a non-concentric cam mechanism may be used to attach the suction cup or pressure plate to the horizontal beam. The cam may be adjusted to move the position of the suction cup/pressure plate to compensate for migration. The cam may also be used during initial positioning to temporarily move the suction cup out of the way so that the rescuer can see if the alignment is proper. In some implementations, the cam mechanism can be operated manually by the rescuer. In a further enhancement used in conjunction with other migration detection features described in this document, the cam mechanism may be operated by an actuator responsive to a processor that is capable of migration detection.

In another enhancement for beam-type CPR machines is to provide rails or other structures on the back plate that can be adjusted to provide lateral stabilization of the patient's torso. The rails provide additional surface contact to the patient's torso, which may help reduce movement or sliding of the torso across the back plate, thereby reducing the migration. This enhancement may also be implemented with inflatable side bags arranged on the vertical supports or with a compression band.

Although described for beam-type CPR machines, these aspects can also be used with other types of CPR machines including belt-type CPR machines, and 1-arm or 2-arm piston-type CPR machines. These aspects may be advantageously used with small patients (e.g., children) to both reduce migration and keep the patient centered on the back plate.

Figure 33A:
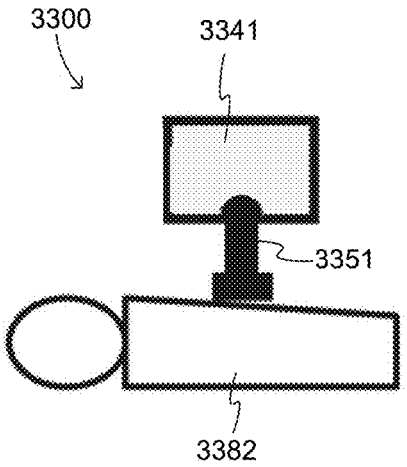
FIG. 33A is a side view of sample salient components of a CPR machine made according to embodiments in which a patient may have shifted upwards.
Figure 33B:
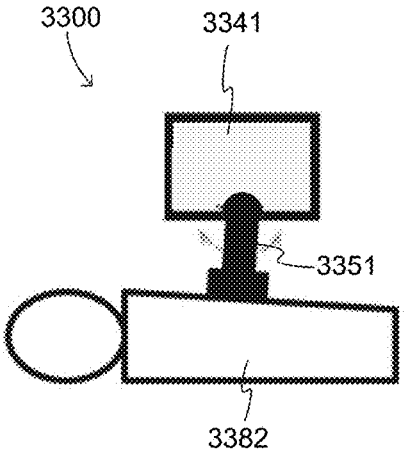
FIG. 33B is a side view of the components of FIG. 33A, which have been adjusted for the patient's shifting.

Additional implementations are now described for adjusting to the fact that the patient may have slipped or shifted. FIG. 33A is a side view of a driver system 3341 and of a piston 3351 of a CPR machine 3300. A patient 3382 may have shifted upwards, and piston 3351 is pressing where the chest is inclined. FIG. 33B is a side view of CPR machine 3300, where it is seen that piston 3351 has been rotated around a hinge or ball joint as an adjustment for the shifting of patient 3382. Compressions are provided at a better angle, and perpendicularly to the chest. Further pushing of the patient upward may be prevented by other restraints (not shown).

Figure 34A:
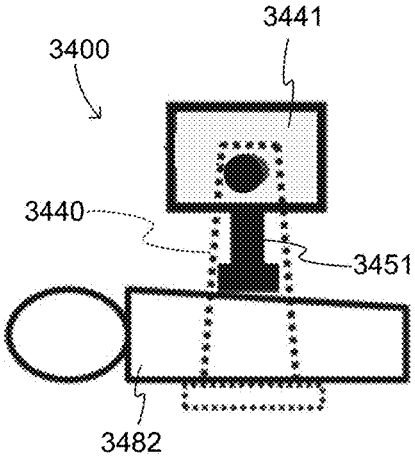
FIG. 34A is a side view of sample salient components of a CPR machine made according to embodiments in which a patient may have shifted upwards.
Figure 34B:
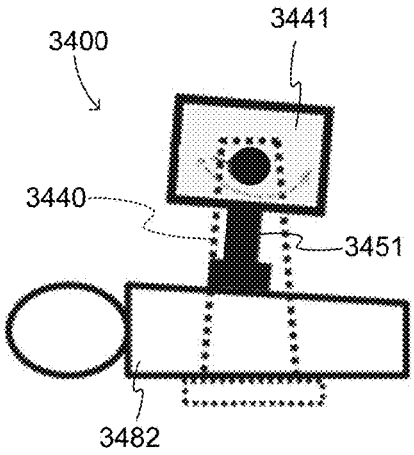
FIG. 34B is a side view of the components of FIG. 34A, which have been adjusted for the patient's shifting.

FIG. 34A is a side view of a retention structure 3440, a driver system 3441 and of a piston 3451 of a CPR machine 3400. A patient 3482 may have shifted upwards, and piston 3451 is pressing where the chest is inclined. FIG. 34B is a side view of CPR machine 3400, where it is seen that driver system 3441 has been rotated around a hinge or ball joint as an adjustment for the shifting of patient 3482. Compressions are provided at a better angle, and perpendicularly to the chest.

In other embodiments, shifting or migration may be detected by detecting a change in the force applied during the CPR chest compressions. The force may be detected as described, for example, in commonly owned copending U.S. patent application Ser. No. 14/616,056, filed on Feb. 6, 2015.

In embodiments, measures are taken to prevent the patient's shifting or slipping within the CPR machine. The surface of the back plate may be coated or laminated with an anti-slip material such as a resilient silicone, or anti-slip silicon stickers or mats can be attached to the back plate. Physical features may be added (via molding or treatment) to the surface of the back plate, which is intended to contact the patient's back. These surface features may be, for example, ridges, grooves, bumps, or other structures (or combinations of such surface features that increase friction or otherwise impede the patient's back from moving across the surface of the back plate).

Suction cups may be placed on places of the retention structure, such as the backboard, the support arms, etc. The suction cups may adhere to the patient's body, and thus prevent migration. Any suitable number and positioning of suction cups can be used in various implementations.

One or more harnesses or stabilization straps may be provided to better secure the patient to the retention structure. This can be similar to the "Singapore" stabilization strap. In one implementation, for example, strap(s) may be fastened at one end to the back plates, and then arranged over the patient's shoulders with the other end(s) of the strap(s) fastened at an upper part of the support structure or to another portion of the back plate. In an enhancement, one or both ends of a strap may be removably fastened to the back plate and/or support structure (e.g., using clips). In an enhancement, the back plate includes one or more holes or slots placed so that straps or belts can be used to secure the patient to the back plate and prevent migration.

Migration during the operation of the CPR machine may be reduced by providing an adhesive to the suction cup or pressure plate at the end of the piston. When the suction cup is initially attached to the patient, the adhesive may anchor the suction cup to its initial position, making it harder for the CPR device to migrate during the CPR compressions.

In the methods described above, each operation can be performed as an affirmative step of doing, or causing to happen, what is written that can take place. Such doing or causing to happen can be by the whole system or device, or just one or more components of it. It will be recognized that the methods and the operations may be implemented in a number of ways, including using systems, devices and implementations described above. In addition, the order of operations is not constrained to what is shown, and different orders may be possible according to different embodiments. Examples of such alternate orderings may include overlapping, interleaved, interrupted, reordered, incremental, preparatory, supplemental, simultaneous, reverse, or other variant orderings, unless context dictates otherwise. Moreover, in certain embodiments, new operations may be added, or individual operations may be modified or deleted. The added operations can be, for example, from what is mentioned while primarily describing a different system, apparatus, device or method.

A person skilled in the art will be able to practice the present invention in view of this description, which is to be taken as a whole. Details have been included to provide a thorough understanding. In other instances, well-known aspects have not been described, in order to not obscure unnecessarily this description. Plus, any reference to any prior art in this description is not, and should not be taken as, an acknowledgement or any form of suggestion that such prior art forms parts of the common general knowledge in any country or any art.

This description includes one or more examples, but this fact does not limit how the invention may be practiced. Indeed, examples, instances, versions or embodiments of the invention may be practiced according to what is described, or yet differently, and also in conjunction with other present or future technologies. Other such embodiments include combinations and sub-combinations of features described herein, including for example, embodiments that are equivalent to the following: providing or applying a feature in a different order than in a described embodiment; extracting an individual feature from one embodiment and inserting such feature into another embodiment; removing one or more features from an embodiment; or both removing a feature from an embodiment and adding a feature extracted from another embodiment, while providing the features incorporated in such combinations and sub-combinations.

In this document, the phrases "constructed to" and/or "configured to" denote one or more actual states of construction and/or configuration that is fundamentally tied to physical characteristics of the element or feature preceding these phrases and, as such, reach well beyond merely describing an intended use. Any such elements or features can be implemented in a number of ways, as will be apparent to a person skilled in the art after reviewing the present disclosure, beyond any examples shown in this document.

Any and all parent, grandparent, great-grandparent, etc. patent applications, whether mentioned in this document or in an Application Data Sheet (ADS) of this patent application, are hereby incorporated by reference herein, including any priority claims made in those applications and any material incorporated by reference, to the extent such subject matter is not inconsistent herewith.

In this description a single reference numeral may be used consistently to denote a single aspect, component, or process. Moreover, a further effort may have been made in the drafting of this description to choose similar though not identical reference numerals to denote versions or embodiments of an aspect, component or process that are the same or possibly different. Where made, such a further effort was not required, but was nevertheless made gratuitously to accelerate comprehension by the reader. Even where made in this document, such an effort might not have been made completely consistently throughout the many versions or embodiments that are made possible by this description. Accordingly, the description controls. Any similarity in reference numerals may be used to confirm a similarity in the text, or even possibly a similarity where express text is absent, but not to confuse aspects where the text or the context indicates otherwise.

The claims of this document define certain combinations and subcombinations of elements, features and steps or operations, which are regarded as novel and non-obvious. Additional claims for other such combinations and subcombinations may be presented in this or a related document. These claims are intended to encompass within their scope all changes and modifications that are within the true spirit and scope of the subject matter described herein. The terms used herein, including in the claims, are generally intended as "open" terms. For example, the term "including" should be interpreted as "including but not limited to," the term "having" should be interpreted as "having at least," etc. If a specific number is ascribed to a claim recitation, this number is a minimum but not a maximum unless stated otherwise. For example, where a claim recites "a" component or "an" item, it means that it can have one or more of this component or item.

What is claimed is:

1. Cardio-Pulmonary Resuscitation ("CPR") machine for performing CPR compressions on a patient, the CPR machine comprising:

a retention structure configured to retain a body of the patient;

a compression mechanism configured to perform CPR chest compressions automatically, while the body is retained by the retention structure and a sight target has been removably placed on the body of the patient by a rescuer, the sight target including an aiming mark that is not aligned with at least one of the CPR chest compressions and further including an indication selected from at least a first indication and a second indication, the CPR compressions alternating with releases to a chest of the patient, the CPR compressions configured to cause the chest to become compressed by at least 2 cm;

a main camera coupled to the retention structure, the main camera having a main field of view that is configured to span at least a portion of the body while the body is retained by the retention structure, the sight target being thus spanned by the main field of view, the main camera configured to acquire a main image of what is spanned by the main field of view, the main image thus including a view of the sight target;

an image processor configured to perform a convolution process on the main image so as to find a position of the view of the sight target for thus detecting automatically whether or not the found position of the view of the sight target is outside a required range, the image processor configured to determine the indication as one of the first indication or the second indication and the compression mechanism configured to adjust the CPR compressions based on the determination of the indication; and a user interface configured to emit an alarm if the position of the view of the sight target is thus detected to be outside the required range.

2. The CPR machine of claim 1, in which the sight target includes cross-hairs, and the view of the sight target includes an image of the cross-hairs.

3. The CPR machine of claim 1, further comprising:

a memory configured to store image data that encode a version of the main image.

4. The CPR machine of claim 1, further comprising:

a light source coupled to one of the retention structure and the compression mechanism, the light source configured to transmit light towards the portion of the body while the body is retained by the retention structure.

5. The CPR machine of claim 1, further comprising:

a mirror coupled to the retention structure, the mirror being within the main field of view, at least a portion of the main image thus acquired through the mirror.

6. The CPR machine of claim 1, in which the sight target includes an attaching device for thus placing the sight target on the body of the patient.

7. The CPR machine of claim 1, in which the sight target includes an adhesive material for thus placing the sight target on the body of the patient.

8. The CPR machine of claim 1, in which the sight target bears an indication associated with the CPR machine, and an image of the indication is part of the main image.

9. The CPR machine of claim 1, further comprising:

a screen configured to display a version of the main image.

10. A non-transitory computer-readable storage medium storing one or more programs which, when executed by a Cardio-Pulmonary Resuscitation ("CPR") machine that includes a user interface, a retention structure retaining a body of a patient while a sight target has been removably placed on the body of the patient by a rescuer, the sight target including an aiming mark and an indication selected from at least a first indication and a second indication, a compression mechanism, a main camera coupled to the retention structure, the main camera having a main field of view that is configured to span at least a portion of the body while the body is retained by the retention structure, the sight target being thus spanned by the main field of view, the main image thus including a view of the sight target, result in operations comprising:

performing automatically by the compression mechanism, while the body is thus retained by the retention structure and the sight target has been removably placed on the body of the patient by the rescuer, the sight target placed such that the aiming mark does not align with a CPR compression, CPR compressions alternating with releases to a chest of the patient, the CPR compressions configured to cause the chest to become compressed by at least 2 cm;

acquiring, by the main camera, a main image of what is spanned by the main field of view;

performing a convolution process on the main image so as to find a position of the view of the sight target;

determining the indication of the sight target as one of the first indication or the second indication;

causing the compression mechanism to adjust CPR compressions based on the determination of the indication;

detecting whether the found position of the view of the sight target is outside a required range; and emitting, by the user interface, an alarm if the view of the sight target is thus detected to be outside the required range.

11. The medium of claim 10, in which the CPR machine further includes a memory, and the operations further comprise storing in the memory image data that encode a version of the main image.

12. The medium of claim 10, in which the CPR machine further includes a communication module, and the operations further comprise causing the communication module to transmitting an image signal that encodes a version of the main image.

13. The medium of claim 10, in which the CPR compressions are performed in a first manner when the indication is determined to be the first indication and are performed in a second manner when the indication is determined to be the second indication.

14. A Cardio-Pulmonary Resuscitation ("CPR") machine, comprising:

a retention structure configured to retain a body of a patient;

a compression mechanism configured to perform automatically, while the body is retained by the retention structure, CPR compressions alternating with releases to a chest of the patient, the CPR compressions configured to cause the chest to become compressed by at least 2 cm;

a mirror coupled to the retention structure;

a main camera coupled to one of the retention structure and the compression mechanism, the main camera having a main field of view that is configured to span at least the mirror and a portion of the body while the body is retained by the retention structure, the main camera configured to acquire a main image of what is spanned by the main field of view, at least a portion of the main image thus acquired through the mirror;

a sight target that is configured to be placed removably by a rescuer at a certain location of the body, the sight target having an aiming mark and placed such that the aiming mark is not aligned with a chest compression and such that the sight target is spanned by the main field of view, the sight target further including an indication selected from at least a first indication and a second indication; and a processor configured to determine the indication as one of the first indication or the second indication from the main image and the compression mechanism further configured to adjust CPR compressions based on the determination of the indication.

15. The CPR machine of claim 14, further comprising:

a memory configured to store image data that encode a version of the main image.

16. The CPR machine of claim 14, further comprising:

a communication module configured to transmit an image signal that encodes a version of the main image.

17. The CPR machine of claim 14, in which the sight target includes an attaching device, and the sight target is so placed at the certain location by using the attaching device.

18. The CPR machine of claim 14, in which the sight target includes an adhesive material, and the sight target is so placed at the certain location by adhering the sight target using the adhesive material.

19. The medium of claim 14, in which the compression mechanism is configured to perform the CPR compressions in a first manner when the indication is determined to be the first indication and in a second manner when the indication is determined to be the second indication.

20. The CPR machine of claim 14, further comprising:

a user interface configured to emit an alarm, if the main image deviates from a base image by more than a threshold.

21. A Cardio-Pulmonary Resuscitation ("CPR") machine, comprising:

a retention structure configured to retain a body of a patient;

a compression mechanism configured to perform automatically, while the body is retained by the retention structure, CPR compressions alternating with releases to a chest of the patient, the CPR compressions configured to cause the chest to become compressed by at least 2 cm;

a sight target configured to be placed removably on the body by a rescuer, the sight target including an aiming mark and an indication selected from one of a first indication and a second indication, the sight target placed such that the aiming mark does not align with a chest compression;

a main camera coupled to one of the retention structure and the compression mechanism, the main camera having a main field of view that is configured to span at least a certain portion of the body and the sight target while the sight target is on the body and the body is retained by the retention structure, the main camera configured to acquire a main image of what is spanned by the main field of view, the main image thus including an image of the indication; and a processor configured to analyze the image of the indication to determine the indication being one of the first indication or the second indication, and in which the compression mechanism is configured to perform the CPR compressions in a first manner when the indication is determined to be the first indication and in a second manner when the indication is determined to be the second indication.

22. The CPR machine of claim 21, in which the sight target includes an attaching device, and the sight target is so placed on the body by the rescuer using the attaching device.

23. The CPR machine of claim 21, in which the sight target includes an adhesive material, and the sight target is so placed on the body by the rescuer adhering the sight target using the adhesive material.

24. The CPR machine of claim 21, in which the sight target includes the indication, the indication being a primary indication, and further includes a secondary indication associated with the CPR machine, and the main image includes an image of the primary indication and the secondary indication.

25. The CPR machine of claim 21, in which the aiming mark is a cross-hairs, and the view of the sight target includes an image of the cross-hairs.

26. The CPR machine of claim 21, further comprising:

a memory configured to store image data that encode a version of the main image.

27. The CPR machine of claim 21, further comprising:

a communication module configured to transmit an image signal that encodes a version of the main image.

28. The CPR machine of claim 21, further comprising:

a light source coupled to one of the retention structure and the compression mechanism, the light source configured to transmit light towards the portion of the body while the body is retained by the retention structure.

29. The CPR machine of claim 21, further comprising:

a user interface configured to emit an alarm, if the main image deviates from a base image by more than a threshold.

* * * * *